US007207191B2

(12) United States Patent
Zhu et al.

(10) Patent No.: US 7,207,191 B2
(45) Date of Patent: Apr. 24, 2007

(54) CRYOGENIC REFRIGERATOR

(75) Inventors: Shaowei Zhu, Kariya (JP); Shin Kawano, Kariya (JP); Tatsuo Inoue, Anjo (JP)

(73) Assignee: Aisin Seiki Kabushiki Kaisha, Kariya-shi (JP)

( * ) Notice: Subject to any disclaimer, the term of this patent is extended or adjusted under 35 U.S.C. 154(b) by 446 days.

(21) Appl. No.: 10/810,810

(22) Filed: Mar. 29, 2004

(65) Prior Publication Data

US 2004/0187519 A1 Sep. 30, 2004

(30) Foreign Application Priority Data

Mar. 28, 2003 (JP) ..... 2003-092027

(51) Int. Cl.
*F25J 1/00* (2006.01)
*F25B 41/00* (2006.01)

(52) U.S. Cl. ..... 62/612; 62/513

(58) Field of Classification Search ..... 62/611, 62/612, 513, 335, 507
See application file for complete search history.

(56) References Cited

U.S. PATENT DOCUMENTS 3,714,796 A * 2/1973 Longsworth ..... 62/51.2
4,646,525 A * 3/1987 Delacour et al. ..... 62/47.1
4,694,662 A * 9/1987 Adams ..... 62/509
4,766,741 A * 8/1988 Bartlett et al. ..... 62/51.2
5,101,894 A * 4/1992 Hendricks ..... 165/164
5,689,962 A * 11/1997 Rafalovich ..... 62/90
2002/0040587 A1* 4/2002 Flynn ..... 62/430

FOREIGN PATENT DOCUMENTS

JP 10-26428 1/1998

* cited by examiner

*Primary Examiner*—William C. Doerrler
(74) *Attorney, Agent, or Firm*—Oblon, Spivak, McClelland, Maier & Neustadt, P.C.

(57) ABSTRACT

A cryogenic refrigerator includes a pressure feeding device, a refrigeration device, a high pressure passage, a low pressure passage, and at least one heat exchanger at the high pressure passage for refrigerating the refrigerant introduced at the high pressure passage by heat exchange, the heat exchanger including an active pressure drop type heat exchanger for declining pressure of the refrigerant at the high pressure passage before being introduced into the refrigeration device. The active pressure drop type heat exchanger declines the pressure of the refrigerant with a ratio equal to or greater than 5 percent out of 100 percent and refrigerates the refrigerant when a pressure difference between a pressure of the refrigerant before being introduced into the active pressure drop type heat exchanger and a pressure of the refrigerant before being introduced into the refrigeration device is defined as 100 percent.

15 Claims, 14 Drawing Sheets

CRYOGENIC REFRIGERATOR

This application is based on and claims priority under 35 U.S.C. § 119 with respect to Japanese Patent Application No. 2003-092027 filed on Mar. 28, 2003, the entire contents of which are incorporated herein by reference.

FIELD OF THE INVENTION

The present invention relates to a cryogenic refrigerator.

BACKGROUND OF THE INVENTION

Known cryogenic refrigerators will be explained with reference to a Joule-Thomson refrigerator. The Joule-Thomson refrigerator described in Japanese Patent Laid-Open Publication No. H10-26428and U.S. Pat. No. 4,766,741 uses the Joule-Thomson effect for attaining the refrigeration performance. With the Joule-Thomson effect, the temperature declines as the pressure of the high pressure gas declines. The Joule-Thomson refrigerator includes a high pressure gas source, a heat exchanger, and a Joule-Thomson valve. The high pressured gas of the high pressure has source is introduced to the heat exchanger to be refrigerated with the return of the low pressured gas at the heat exchanger. Further, the high pressured gas generates enthalpy expansion to have the low pressure through the Joule-Thomson valve, or the like, to decline the temperature of the refrigerant, which provides the refrigeration performance.

Generally, a 4K refrigerator for obtaining the refrigeration at approximate to 4K includes a Joule-Thomson refrigerator including a Joule-Thomson circuit, a two-stepped pulse tube refrigerator for pre-cooling, and a compressor unit for supplying the high pressure gas. This is the effective method for achieving the temperature at 4K by helium gas. The 4K refrigerators are mainly used for refrigerating MR1, SQUID, and other superconductive device, or the like.

The refrigerator including the Joule-Thomson circuit and the two-stepped pulse tube refrigerator for the pre-cooling mainly include three parts including the compressor portion, the Joule-Thomson circuit, and the two-stepped pulse tube refrigerator.

The cryogenic refrigerator further advantageous for obtaining the cryogenic temperature is to be developed.

A need thus exists for a cryogenic refrigerator which is advantageous for attaining the cryogenic temperature and advantageous for the liquefaction of the refrigerant.

SUMMARY OF THE INVENTION

In the of the foregoing, the present invention provides a cryogenic refrigerator which includes a discharging port for pressure-feeding a refrigerant, a suction port for sucking the refrigerant, a pressure feeding means including the discharging port and the suction port, a refrigeration means for refrigerating a body to be refrigerated, a high pressure passage for establishing communication between the discharging port of the pressure feeding means and the refrigeration means, the high pressure passage being introduced with the refrigerant with relatively high pressure, a low pressure passage for establishing the communication between the suction port of the pressure feeding means and the refrigeration means, the low pressure passage being introduced with the refrigerant with relatively low pressure, and at least one heat exchanger at the high pressure passage for refrigerating the refrigerant introduced at the high pressure passage by heat exchange, the heat exchanger including an active pressure drop type heat exchanger for declining pressure of the refrigerant at the high pressure passage before being introduced into the refrigeration means. The active pressure drop type heat exchanger declines the pressure of the refrigerant with a ratio equal to or greater than 5 percent out of 100 percent and refrigerates the refrigerant when a pressure difference between a pressure of the refrigerant before being introduced into the active pressure drop type heat exchanger and a pressure of the refrigerant before being introduced into the refrigeration means is defined as 100 percent.

BRIEF DESCRIPTION OF THE DRAWING FIGURES

The foregoing and additional features and characteristics of the present invention will become more apparent from the following detailed description considered with reference to the accompanying drawing figures in which like reference numerals designate like elements.

DETAILED DESCRIPTION OF THE INVENTION

Figure 1:
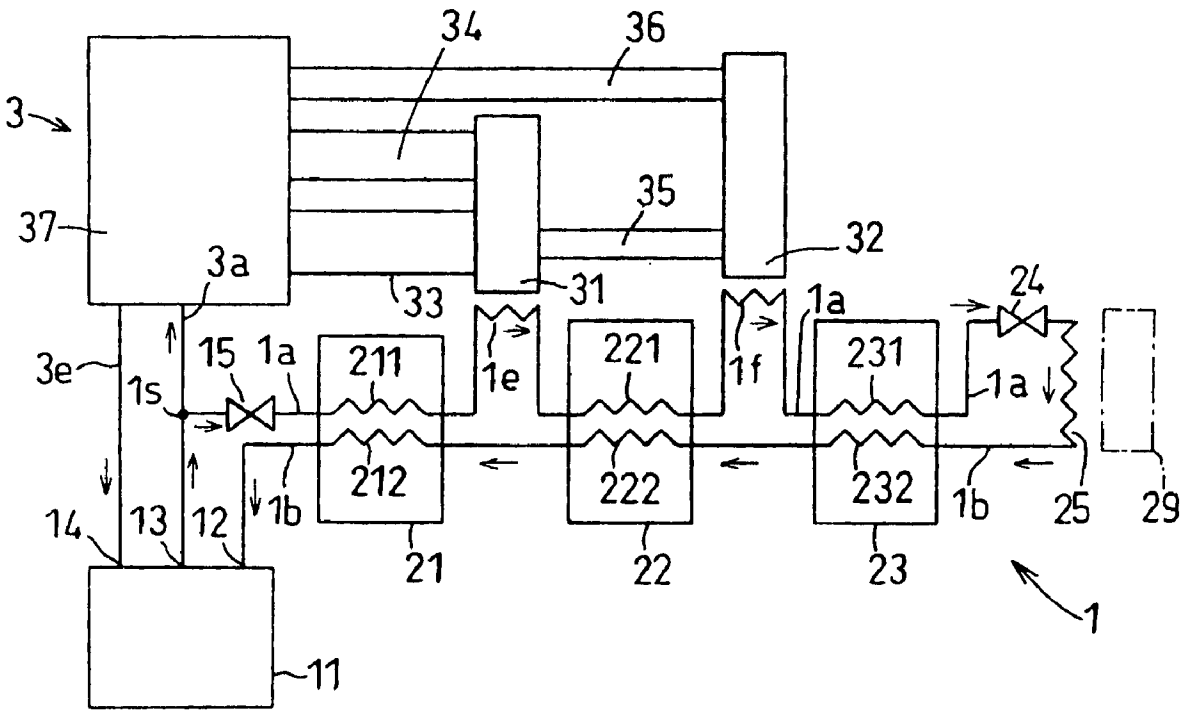
FIG. 1 shows an overview of a cryogenic refrigerator according to an embodiment of the present invention.

Embodiments of the present invention will be explained with reference to the illustrations of the drawings as follows.

According to a cryogenic refrigerator of the embodiments, an active pressure drop type heat exchanger declines the gas pressure while refrigerating refrigerant gas by the heat exchange. When the pressure difference between a pressure Ph of the refrigerant before being introduced into the active pressure drop type heat exchanger and a pressure Pc of the refrigerant before being introduced into a refrigeration means is defined as 100 percent, the active pressure drop type heat exchanger refrigerates the refrigerant by actively declining the pressure of the refrigerant with a ratio of equal to or greater than 5 percent out of 100 percent. The degree for declining the pressure of the refrigerant may be varied depending on the constructions of the heat exchanger, the variations of the refrigerant (e.g., helium, nitrogen, neon, argon, carbon dioxide, methane, ethane, propane, butane, various fluorocarbons, hydrogen, oxygen, and mixture thereof), and the targeted cryogenic temperature.

In this case, the active pressure drop type heat exchanger may decline the pressure of the refrigerant with the ratio of equal to or greater than 10 percent out of 100 percent, with the ratio of equal to or greater than 20 percent out of 100 percent, with the ratio of equal to or greater than 30 percent out of 100 percent, with the ratio of equal to or greater than 40 percent out of 100 percent, or with the ratio of equal to or greater than 50 percent of 100 percent. Further, the active pressure drop type heat exchanger may decline the pressure of the refrigerant with the ratio of equal to or greater than 60 out of 100 percent, with the ratio of equal to or greater than 70 out of 100 percent, with the ratio of equal to or greater than 80 percent out of 100 percent, or with the ratio of equal to or greater than 90 percent out of 100 percent. Moreover, the active pressure drop type heat exchanger may decline the pressure of the refrigerant with the ratio of equal to or greater than 93 percent out of 100 percent, with the ratio of equal to or greater than 95 percent out of 100 percent, or with the ratio of 100 percent. In case the pressure of the refrigerant is declined with the ratio of 100 percent, generally, the refrigerant is liquefied at an outlet of the active pressure drop type heat exchanger.

According to the embodiments of the present invention, when the temperature difference between a temperature Th of the refrigerant before being introduced into the active pressure drop type heat exchanger at a high pressure passage and a temperature Tc of the refrigerant before being introduced into the refrigeration means are defined as 100 percent, the active pressure drop type heat exchanger may decline the temperature of the refrigerant with the ratio of equal to or greater than 5 percent out of 100 percent while declining the pressure of the refrigerant. The degree for declining the temperature of the refrigerant may be varied depending on the constructions of the heat exchanger, the variations of the refrigerant (e.g., helium, nitrogen, neon, argon, carbon dioxide, methane, ethane, propane, butane, various fluorocarbons, hydrogen, oxygen, and mixture thereof), and the targeted cryogenic temperature.

According to the embodiments of the present invention, with the active pressure drop type heat exchanger, refrigerating the refrigerant simultaneous with declining the pressure of the refrigerant is advantageous for obtaining the cryogenic temperature and for increasing the liquefaction ratio of the refrigerant such as helium, nitrogen, neon, argon, carbon dioxide, methane, ethane, propane, butane, various fluorocarbons, hydrogen, oxygen, and mixture thereof. In this case, when the temperature difference between the temperature Th and the temperature Tc is determined 100 percent, the active pressure drop type heat exchanger declines the temperature of the refrigerant with the ratio equal to or greater than 10 percent out of 100 percent, with the ratio of equal to or greater than 20 percent out of 100 percent, with the ratio of equal to or greater than 30 percent out of 100 percent, with the ratio of equal to or greater than 40 percent out of 100 percent, or with the ratio of equal to or greater than 50 percent out of 100 percent. Further, the active pressure drop type heat exchanger declines the temperature of the refrigerant with the ratio of equal to or greater than 60 percent out of 100 percent, with the ratio of equal to or greater than 70 percent out of 100 percent, with the ratio of equal to or greater than 80 percent out of 100 percent, or with the ratio of equal to or greater than 90 percent out of 100 percent. Moreover, the active pressure drop type heat exchanger may decline the temperature of the refrigerant with the ratio of equal to or greater than 95 percent out of 100 percent, or with the ratio of 100 percent.

According to the cryogenic refrigerator of the present invention, plural heat exchangers are provided. The heat exchanger provided closest to the refrigeration means in terms of the flow of the refrigerant among the plural heat exchanger may correspond to the active pressure drop type heat exchanger. This arrangement is advantageous for obtaining the cryogenic temperature and for increasing the liquefaction of the refrigerant such as helium, nitrogen, neon, argon, carbon dioxide, methane, ethane, propane, butane, various fluorocarbons, hydrogen, oxygen, and mixture thereof. Further, because the refrigerant with the high pressure can be supplied approximate to the refrigeration means with the foregoing construction, it is advantageous for ensuring the flow amount of the refrigerant to attain the high refrigeration performance.

According to the embodiments of the present invention, the active pressure drop type heat exchanger may refrigerate the refrigerant at the high pressure passage by the heat exchange with the refrigerant at a low pressure passage.

According to the embodiments of the present invention, the cryogenic refrigerator includes a pre-cooling refrigerator. The high pressure passage may include a pre-cooling portion for pre-cooling the refrigerant at the high pressure passage with the pre-cooling refrigerator. This construction is advantageous for refrigerating the refrigerant. The pre-cooling refrigerator includes a pulse tube refrigerator, a Gifford McMahon type cryogenic refrigerator, a Solvay type cryogenic refrigerator, Vuilleumier refrigerator, and Stirling type cryogenic refrigerator, or the like.

According to embodiments of the present invention, the cryogenic refrigerator includes a pressure feeding means. The pressure feeding means supplies the refrigerant to the high pressure passage and supplies the refrigerant to the pre-cooling refrigerator. In this case, the pressure feeding means is shared with the pre-cooling refrigerator.

According to the cryogenic refrigerator of the embodiments, the active pressure drop type heat exchanger includes a pressure drop passage in communication with the high pressure passage and enabling the heat exchange with a heat exchange medium. The average diameter of the pressure drop passage may be determined 0.1–15 millimeters. The average diameter of the pressure drop passage may be varied depending on the variations of the refrigerator. This construction is advantageous for declining the pressure of the refrigerant while refrigerating the refrigerant. In this case, the average diameter of the pressure drop passage may be 0.5–10 millimeters, or 1–5 millimeters. When the diameter of the pressure drop passage is small, the length of the pressure drop passage can be shortened because the pressure drop of the refrigerant at the active pressure drop type heat exchanger assumes large. The upper limit of the diameter of the pressure drop passage may be 0.5 millimeters, 0.7 millimeters, 1 millimeter, 2 millimeters, 3 millimeters, 5 millimeters, or the like.

According to the cryogenic refrigerator of the embodiments, the active pressure drop type heat exchanger includes the pressure drop passage in communication with the high pressure passage and enabling the heat exchange with the heat exchange medium. The length of the pressure drop passage may be determined to be 0.1–200 meters. The length of the pressure drop passage may be varied depending on the diameter of the pressure drop passage. This construction is advantageous for declining the pressure of the refrigerant while refrigerating the refrigerant. Because the pressure drop can be increased when the diameter of the pressure drop passage is small, the length of the pressure drop passage can be shortened. The upper limit of the length of the pressure drop passage may be 10 meters, 20 meters, 50 meters, 70 meters, 100 meters, and 150 meters, or the like.

According to the cryogenic refrigerator of the embodiments of the present invention, the active pressure drop type heat exchanger may include a pressure drop passage in communication with the high pressure passage, formed in spiral configuration, and enabling the heat exchange with the heat exchange medium. This construction is advantageous for declining the pressure of the refrigerant while refrigerating the refrigerant. Because the pressure drop passage is configured to be spiral, it is advantageous for shortening the length of the active pressure drop type heat exchanger.

According to the cryogenic refrigerator of the embodiments of the present invention, the active pressure drop type heat exchanger includes the pressure drop passage in communication with the high pressure passage and enabling the heat exchange with the heat exchange medium. The pressure drop passage may include a resistive element serving as a resistance against the flow of the refrigerant in the passage. This configuration is advantageous for declining the pressure of the refrigerant while refrigerating the refrigerant.

According to the cryogenic refrigerator of the embodiments of the present invention, active pressure drop type heat exchanger includes a passage for forming member forming a pressure drop passage in communication with the high pressure passage and for enabling the heat exchange with the heat exchange medium. A spacer may be provided between the passage forming members. Thus, the active pressure drop type heat exchanger is advantageous for refrigerating the refrigerant by the heat exchange because the passage where the heat exchange medium flows is formed between the passage forming members.

According to the cryogenic refrigerator of the embodiments of the present invention, the active pressure drop type heat exchanger includes a porous body for forming a pressure drop passage having a small bore. The pressure drop passage is in communication with the high pressure passage and is enable to exchange the heat with the heat exchange medium. The small bore of the porous body having a small diameter is advantageous for forming the pressure drop passage. In this case, the small bore of the porous body is advantageous for declining the pressure of the refrigerant while refrigerating the refrigerant.

According to the cryogenic refrigerator of the embodiments of the present invention, the active pressure drop type heat exchanger includes a pressure drop passage in Communication with the high pressure passage and enabling the heat exchange with the heat exchange medium. The pressure drop passage may be formed by arranging plural plate members each including a penetration bore. The diameter of the penetration bore influences on the decline of the gas pressure of the refrigerant at the pressure drop passage. This configuration is advantageous for declining the pressure of the refrigerant while refrigerating the refrigerant. The heat exchange medium may include the refrigerant introduced at the low pressure passage. Other media may be used as the heat exchange medium.

According to the cryogenic refrigerator of the embodiments of the present invention, the refrigerant may include helium, nitrogen, neon, argon, carbon dioxide, methane, ethane, propane, butane, various fluorocarbons, hydrogen, oxygen, or mixture thereof. In case the refrigerant corresponds to helium, the pressure Ph of the refrigerant before being introduced into the active pressure drop type heat exchanger may be determined to be 0.1–10 Mpa. The pressure Ph may be determined to have 0.4–5 Mpa, 1–3 Mpa, or the like. In case the refrigerant corresponds to helium, the temperature Th of the refrigerant before being introduced into the active pressure drop type heat exchanger may be determined to be 2–30K The temperature Th may be determined to be 4–20K, 8–15K, or the like. According to the cryogenic refrigerator of the embodiments, in case the refrigerant corresponds to helium, the pressure of the gas refrigerant outputted from a discharging port of the pressure feeding means may be determined to be equal to or greater than 1.8 Mpa, equal to or greater than 2.0 Mpa, and equal to or greater than 2.2 Mpa, or the like. The upper limit of the pressure of the gas refrigerant may be determined to be equal to or less than 10 Mpa.

The pressure feeding means may be shared between the cryogenic refrigerator and the pre-cooling refrigerator and the refrigerant discharged from the discharging port of the pressure feeding means may be supplied the both to the high pressure passage of the cryogenic refrigerator and to the high pressure passage of the pre-cooling refrigerator. In this case, it is preferable to determine the pressure of the refrigerant discharged from the discharging port of the pressure feeding means at the refrigerant pressure appropriate for the high pressure passage at the pre-cooling refrigerator. Thus, in case the refrigerant corresponds to helium, the pressure of the high pressure gas of the refrigerant discharged from the discharging port of the pressure feeding means may be determined to be 1.0–5.0 Mpa, 1.5–3.0 Mpa, or the like. The pressure of the refrigerant discharged from the discharging port of the pressure feeding means may be determined as the pressure Ph.

In case the pre-cooling refrigerator corresponds to a pulse tube refrigerator, the refrigerant discharged from the discharging port of the pressure feeding means may be supplied to the high pressure passage of the cryogenic refrigerator and the high pressure passage of the pulse tube refrigerator. In other words, the pressure feeding means can be shared between the high pressure passage of the cryogenic refrigerator and the high pressure passage of the pulse tube refrigerator. In case the pressure feeding means is shared between the high pressure passage of the cryogenic refrigerator and the high pressure passage of the pulse tube refrigerator, it is preferable to determine the pressure of the refrigerant discharged from the discharging port of the pressure feeding means at the appropriate refrigerant pressure of the high pressure passage of the pulse tube refrigerator. Accordingly, the pressure of the gas refrigerant discharged from the discharging port of the pressure feeding means may be determined to be 1.0–6 Mpa, 1.5–3.5 Mpa, or the like. Depending on the refrigerant, the pressure Ph may be ranged to be 0.1 Mpa–1000 Mpa.

A first embodiment of the present invention will be explained as follows. As shown in FIG. 1, the cryogenic refrigerator includes a main refrigeration circuit 1 including a Joule-Thomson circuit for refrigerating a body 29 to be refrigerated serving as an object to be refrigerated and a pulse tube refrigerator 3 serving as a pre-cooling refrigerator including a pre-cooling function relative to the main refrigeration circuit 1.

As shown in FIG. 1, the main refrigeration circuit 1 includes a compressor portion 11 serving as a pressure feeding means for pressure feeding the refrigerant, a refrigeration means 25 for refrigerating the body 29 to be refrigerated, a high pressure gas port 13 serving as a discharging port at high pressure side of the compressor portion 11, a high pressure passage 1*a* establishing a communication between the high pressure gas port 13 and the refrigeration means 25 and introduced with relatively high pressured refrigerant gas, a low pressure gas port 12 serving as a suction port at the low pressure side of the compressor portion 11, a low pressure passage 1*b* establishing the communication between the low pressure gas port 12 and the refrigeration means 25 and introduced with relatively low pressured refrigerant gas, and plural heat exchangers 21, 22, 23 arranged in series with the high pressure passage 1*a* for refrigerating the gas refrigerant introduced at the high pressure passage 1*a* by the heat exchange.

The refrigeration means 25 refrigerates the body 29 to be refrigerated by the heat exchange. In this embodiment, the refrigerant corresponds to helium. According to the embodiment, the refrigeration means 25 is positioned at vertically downward relative to the compressor portion 11 in the main refrigeration circuit 1 in order to prevent the decline of the refrigeration performance by the natural convection of the refrigerant.

As shown in FIG. 1, the heat exchanger 21 includes a high pressure gas passage 211 in communication with the high pressure passage 1*a* and a low pressure gas passage 212 in communication with the low pressure passage 1*b* at the return side. The heat exchanger 21 may be a counterflow type heat exchanger where the high pressure gas and the low pressure gas flow in the opposite directions. With the heat exchanger 21, the refrigerant introduced at the high pressure gas passage 211 and the refrigerant introduced at the low pressure gas passage 212 exchange the heat each other. The heat exchanger 21 does not actively decline the gas pressure of the refrigerant introduced at the high pressure gas passage 211 and the gas pressure of the refrigerant introduced at the low pressure gas passage 212.

The heat exchanger 22 includes a high pressure gas passage 221 in communication with the high pressure passage 1*a* and a low pressure gas passage 222 in communication with the low pressure passage 1*b* at the return side. The heat exchanger 22 may be a counterflow type heat exchanger where the high pressure gas and the low pressure gas flow in the opposite directions. With the heat exchanger 22, the refrigerant introduced at the high pressure gas passage 221 and the refrigerant introduced at the low pressure gas passage 222 exchange the heat each other. The heat exchanger 22 does not actively decline the gas pressure of the refrigerant introduced at the high pressure gas passage 221 and the gas pressure of the refrigerant introduced at the low pressure gas passage 222.

The heat exchanger 23 includes a high pressure gas passage 231 in communication with the high pressure passage 1*a* and a low pressure gas passage 232 in communication with the low pressure passage 1*b* at the return side. The heat exchanger 23 may be a counterflow type heat exchanger where the high pressure gas and the low pressure gas flow in the opposite directions. With the heat exchanger 23, the refrigerant introduced at the high pressure gas passage 231 and the refrigerant introduced at the low pressure gas passage 232 exchange the heat each other. The heat exchanger 23 actively decline the gas pressure of the refrigerant introduced at the high pressure gas passage 231 but does not actively decline the gas pressure of the refrigerant introduced at the low pressure gas passage 232.

As shown in FIG. 1, a valve 15 having a needle valve construction serving as a refrigerant resistor is provided at the high pressure passage 1*a* at the most upstream side among the heat exchangers 21–23. A Joule-Thomson valve 24 serving as the refrigerant resistor is provided between the refrigeration means 25 and the downstream of the heat exchanger 23 positioned at the most downstream side among the heat exchangers 21–23.

Thus, the active pressure drop type heat exchanger 23 is the last heat exchanger at the high pressure passage 1*a* side positioned immediately before the refrigeration means 25 and is arranged closest with the refrigeration body refrigeration means 25 and the Joule-Thomson valve 24. The passage lengths of the valve 15 and the Joule-Thomson valve 24 are short although the valve 15 and the Joule-Thomson valve 24 include a small diameter and a throttle bore.

As shown in FIG. 1, the compressor portion 11 for compressing refrigerant gas includes the high pressure gas port 13 for discharging the high pressure gas of the refrigerant at 2.4 Mpa, a middle pressure gas port 14 serving as a suction port for sucking the middle pressure gas of the refrigerant at 1 Mpa, and a low pressure port 12 for sucking the low pressure gas of the refrigerant at 0.1 Mpa.

The refrigerant gas flows from the high pressure gas portion 13 to the main refrigeration circuit 1 by the actuation of the compressor portion 11 to pass through a divergent point 1*s*, the valve 15, the high pressure gas passage 211 of the heat exchanger 21 at the high pressure passage 1*a*, the high pressure gas passage 221 of the heat exchanger 22, the high pressure gas passage 231 of the heat exchanger 23 in order. Further, the refrigerant gas reaches the refrigeration means 25 via the Joule-Thomson valve 24 to refrigerate the body 29 to be refrigerated. With the refrigeration means 25, the refrigeration performance approximately at 4.2K may be achieved, The refrigeration means 25 includes a long pipe to refrigerate the body 29 to be refrigerated. The refrigerant cooled the body 29 to be refrigerated returns to the low pressure gas port 12 of the compressor portion 11 via the low pressure gas passage 232 of the heat exchanger 23 at the low pressure passage 1*b*, the low pressure gas passage 222 of the heat exchanger 22, and the low pressure gas passage 212 of the heat exchanger 21 in order.

The pulse tube refrigerator 3 serving as the pre-cooling refrigerator relative to the main refrigeration circuit 1 includes a first cold head 31 positioned at relatively high temperature side and reaching the temperature approximately at 80K and a second cold head 32 positioned at the relatively low temperature side reaching the temperature approximately at 12K. The pulse tube refrigerator 3 is connected to the high pressure gas port 13 of the compressor portion 11 via the high pressure passage 3*a* serving as a discharging passage and the divergence point is and is connected to the middle gas port 14 via a middle pressure passage 3*e* serving as a suction passage.

As shown in FIG. 1, the pulse tube refrigerator 3 includes a first thermal accumulator 33, a first pulse tube 34, a second thermal accumulator 35, a second pulse tube 36, an a unit 37 in the room temperature region including valves, buffers, and other members. The refrigerant gas is supplied to the pulse tube refrigerator 3 from the high pressure gas port 13 of the compressor portion 11 via the divergence point 1*s* by the actuation of the compressor portion 11 to be returned to the middle pressure gas port 14. Thus the pulse tube refrigerator 3 shows the refrigeration performance at the first cold head 31 and the second cold head 32. The first cold head 31 serving as a first stage is for pre-cooling a first pre-cooling portion 1*e* of the main refrigeration circuit 1 corresponding to the Joule-Thomson circuit. The second cold head 32 serving as a second stage pre-cools a second pre-cooling portion 1*f* of the main refrigeration circuit 1 corresponding to the Joule-Thomson circuit. The first cold head 31 and the second cold head 32 are arranged to be positioned vertically downward relative to the unit 37 at the pulse tube refrigerator 3 in order to prevent the decline of the refrigeration performance by the natural convection of the refrigerant.

As shown in FIG. 1, the high pressure gas of the refrigerant introduced at the high pressure passage 1*a* discharged from the high pressure gas port 13 of the compressor portion 11 passes through the high pressure gas passage 211 of the heat exchanger 21, passes through the first pre-cooling portion 1*e* pre-cooled at the first cold head portion 31, and is refrigerated to be temperature approximate to 80K. Further, the high pressure gas introduced at the high pressure passage 1*a* passes through the high pressure gas passage 221 of the heat exchanger 22, passes through the second pre-cooling portion 1*f* pre-cooled at the second cold head 32, and is refrigerated equal to or higher than 12K. As foregoing manner, refrigerant gas introduced at the high pressure passage 1*a* is introduced into the high pressure gas passage 231 of the heat exchanger 23 arranged the last before the refrigeration means 25 and positioned closest to the refrigeration means 25 while being refrigerated approximate to 21K by the second pre-refrigeration means 1*f*, and further refrigerated approximate to 5K by the refrigerant gas introduced at the low pressure gas 232 at the return side of the heat exchanger 23.

Further, refrigerant gas discharged from the high pressure gas passage 231 of the heat exchanger 23 passes through the Joule-Thomson valve 24. Thereafter, the pressure of the refrigerant gas is decreased to the pressure (0.1 Mpa) for liquefying helium by the Joule-Thomson valve 24. Thus, the liquefaction of the refrigerant is proceeded to generate liquid helium.

With the embodiment of the present invention, the heat exchanger 23 positioned closest to the refrigeration means 25 serving as the refrigeration means among the plural heat exchangers 21, 22, 23 serves as the active pressure drop type heat exchanger. The operation of the active pressure drop type heat exchanger will be explained as follows. The heat exchanger 23 is set to function favorably at the condition that the flow amount of the refrigerant assumes 1 g/s. The heat exchanger 23 arranged the last before the refrigeration means 25 includes the high pressure gas passage 231 and the low pressure gas passage 232 at the return side. The pressure of the refrigerant gas before being introduced into the high pressure gas passage 231 of the heat exchanger 23 is approximately 2.4 Mpa. Before being introduced into the high pressure gas passage 231 of the heat exchanger 23, the refrigerant gas is refrigerated to approximately 12K by the second cold head 32 of the pulse tube refrigerator 3 and the second pre-cooling portion 1*f*. According to the embodiment, the refrigerant is liquefied at approximately 0.1 Mpa (zero pressure by gauge pressure). The pressure is determined as 0.1 Mpa to correspond to the atmosphere considering the prevention of the invasion of the outside air at the pipes. Thus, according to the embodiment, the pressure of the refrigerant before being introduced into the low pressure gas passage 232 assumes approximately 0.1 Mpa. The boiling point of helium at 0.1 Mpa is 4.21K.

The low temperature end side of the heat exchanger 23 serves as a cold end. The high temperature side of the heat exchanger 23 serves as a hot end. According to the embodiment, because the refrigeration of the low pressure gas at the heat exchanger 23 is used for the refrigeration of the high pressure gas, the temperature difference between the high pressure gas passage 231 and the low pressure gas passage 232 at the hot end of the heat exchanger 23 can be determined approximately 0.2K. Accordingly, the favorable heat exchanger 23 is attained.

The Joule-Thomson valve 24 including a very small diameter is unlikely clogged by the solid impurity such as the frozen material. According to the embodiment, the Joule-Thomson valve 24 is used for the final adjustment. In other words, the Joule-Thomson valve 24 is useful for the final adjustment for the pressure drop of the refrigerant gas. In case the pressure of the refrigerant gas is largely declined by the active pressure drop type heat exchanger 23, the Joule-Thomson valve 24 may be omitted. Thus, it is preferable to increase the pressure drop at the high pressure passage 231 of the active pressure drop type heat exchanger 23 as great as possible. In case the high pressure gas passage 231 of the heat exchanger 23 can sufficiently decline the pressure of the refrigerant, the role for the pressure drop at the Joule-Thomson valve 24 can be significantly decreased by increasing the passage diameter of the Joule-Thomson valve 24, which restrains the drawbacks that the passage of the Joule-Thomson valve 24 is clogged by the solid impurity, or the like.

The passage diameter of the Joule-Thomson valve 24 is configured to be very small likely to be close by the solid impurity. Although the heat exchanger 23 is active pressure drop type, the diameter of the high pressure gas passage 231 is much greater than the passage diameter of the Joule-Thomson valve 24. Accordingly the chance that the high pressure gas passage 231 of the heat exchanger 23 is clogged by the solid impurity is significantly decreased.

According to the embodiments of the present invention, with the heat exchanger 23, a downstream portion (i.e., pressure drop passage) of the high pressure gas passage 231 approximate to the Joule-Thomson valve 24 may be formed with a long thin tube having the small diameter for generating the high pressure drop. Thus, the downstream portion of the high pressure gas passage 231 of the heat exchanger 23 includes the small diameter for attaining the high pressure drop. According to the embodiment of the present invention, an internal diameter of the upstream portion of the high pressure gas passage 231 is determined to have 3 millimeters and an internal diameter of the downstream portion of the high pressure gas passage 231 is determined to have 1 millimeter, which is smaller than the internal diameter at the upstream portion of the high pressure gas passage 231.

The heat exchanger 23 operated at the condition that the flow amount is 1 g/s will be further explained as follows. According to the embodiment of the present invention, the pressure of the refrigerant gas before being introduced into the high pressure gas passage 231 of the heat exchanger 23 is approximately 2.4 Mpa. The refrigerant is refrigerated to be approximately 12K by the second cold head 32 of the pulse tube refrigerator 3 before being introduced into the high pressure gas passage 231 of the heat exchanger 23. The refrigerant at the low pressure gas passage 232 of the heat exchanger 23 has the low pressure approximately at 0.1 Mpa. The boiling point of helium gas at 0.1 Mpa (i.e., liquefaction temperature) is 4.21K.

Figure 2:
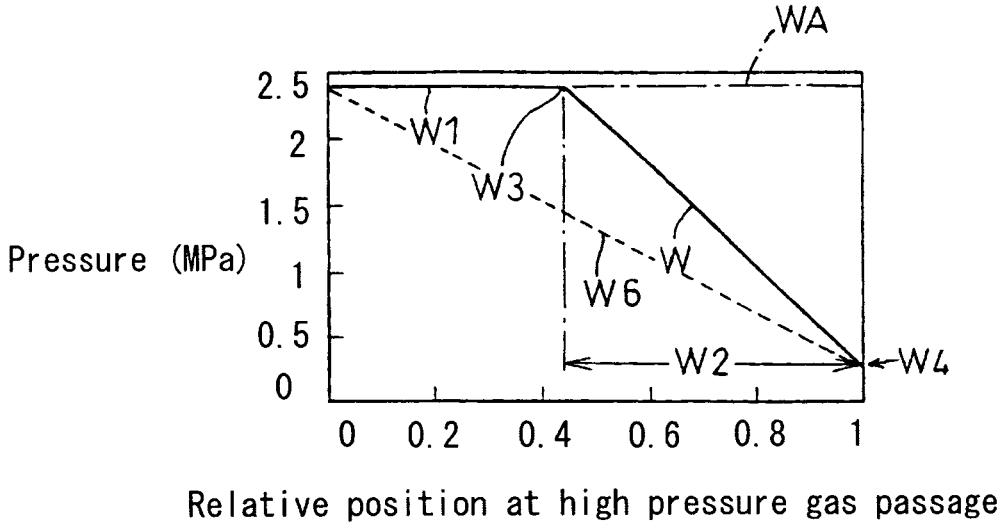
FIG. 2 is a graph showing the pressure drop of the refrigerant at a high-pressure gas passage of an active pressure drop type heat exchanger.

As shown in FIG. 2, a characteristic line W shows a pressure change of the refrigerant gas at the high-pressure gas passage 231 of the active pressure drop type heat exchanger 23. The horizontal line of FIG. 2 shows the relative position at the high pressure gas passage 231 of the heat exchanger 23. The vertical line of FIG. 2 shows the pressure of the refrigerant at the high pressure passage 231 of the heat exchanger 23.

Figure 3:
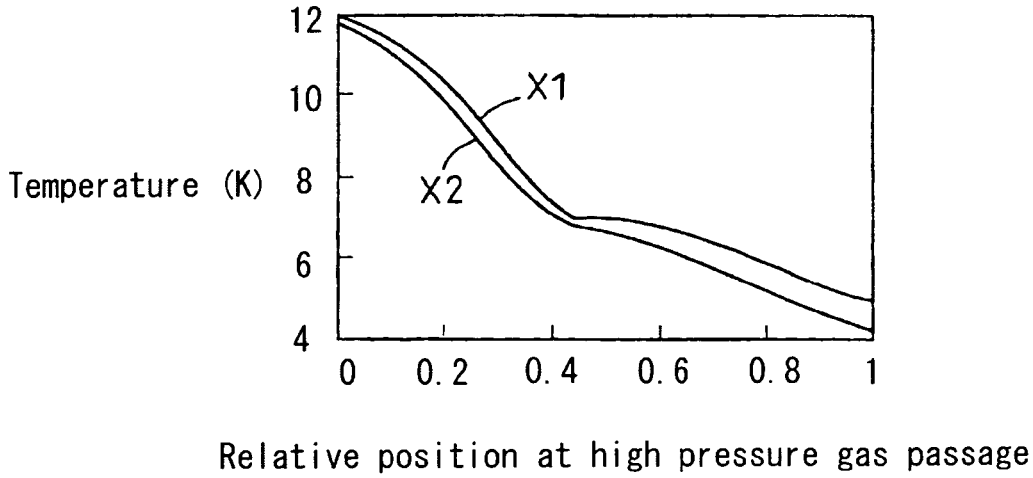
FIG. 3 is a graph showing variations of the temperatures of the high pressure-gas of the refrigerant at the high pressure gas passage of the active pressure drop type heat exchanger and the low pressure gas of the refrigerant at a low pressure gas passage.

A characteristic line X1 of FIG. 3 shows the temperature change of the high pressure gas of the refrigerant at the high pressure gas passage 231 of the active pressure drop type heat exchanger 23. The characteristics line X2 of FIG. 3 shows the temperature change of the low pressure gas of the refrigerant at the low pressure gas passage 232 of the active pressure drop type heat exchanger 23. The horizontal line of FIG. 3 shows the relative position at the high pressure gas passage 231 and the low pressure gas passage 232 of the active pressure drop type heat exchanger 23. The vertical line of FIG. 3 shows the temperature of the refrigerant at the low pressure gas passage 232 and at the high pressure gas passage 231 of the active pressure drop type heat exchanger 23.

According to the embodiment of the present invention, as shown with a line W1, the pressure of the refrigerant gas hardly declines at the upstream portion at the relatively high temperature side of the high pressure passage 231 of the heat exchanger 23. However, as indicated with a region W2 after a portion W3 in FIG. 2, the pressure of the refrigerant is gradually declined at the region W2 of the high pressure gas passage 231 of the heat exchanger 23 as moving to the downstream of the high pressure gas passage 231 of the heat exchanger 23. Thus, the pressure of the refrigerant discharged from the high pressure gas passage 231 of the heat exchanger 23 assumes approximately 0.27 Mpa as shown with W4 of the characteristics line W of FIG. 2.

In other words, the pressure of the refrigerant gas at the high pressure gas passage 231 of the heat exchanger 23 declines from approximately 2.4 Mpa to approximately 0.27 Mpa. The pressure declines at the active pressure drop type heat exchanger 23 is approximately 2.13 Mpa in this embodiment (2.13 Mpa=2.4 Mpa−0.27 Mpa).

In this case, defining the pressure Ph of the refrigerant before being introduced into the active pressure drop type heat exchanger 23 (i.e., Ph equal to approximately 2.4 Mpa) and defining the pressure Pc of the refrigerant before being introduced into the refrigeration means 25 (i.e., Pc equals to approximately 0.1 Mpa), the pressure difference ΔP between the pressure ph and the pressure Pc assumes approximately 2.3 Mpa (2.3 Mpa=2.4 Mpa−0.1 Mpa). In case the pressure difference ΔP is determined as 100 percent, the active pressure drop type heat exchanger 23 declines the pressure of the refrigerant with the ratio of 93 percent out of 100 percent (i.e., 2.13 Mpa/2.3 Mpa·100%≈93%).

As shown in FIG. 2, the pressure of the refrigerant gas declines by approximately 2 Mpa–2.3 Mpa at the high pressure gas passage 231 of the heat exchanger 23. As shown in FIG. 2, the pressure drop from the portion W3 is approximately linear.

The temperature distribution of the high pressure gas introduced at the high pressure gas passage 231 of the heat exchanger 23 and the low pressure gas introduced at the low pressure gas passage 232 of the heat exchanger 23 is shown in FIG. 3. As shown in FIG. 3, with the high pressure gas introduced at the high pressure gas passage 231, the temperature of the refrigerant is increased at the temperature of approximately 7K because the pressure is declined. This is advantageous for the heat transfer.

As shown with characteristics lines X1, X2 of FIG. 3, the temperature of the refrigerant gas at the high pressure gas passage 231 of the heat exchanger 23 declines from approximately 12K to approximately 5K. In other words, the temperature declines at the heat exchanger 23 is approximately 7K.

In this case, defining the temperature Th of the refrigerant before being introduced into the active pressure drop type heat exchanger 23 (i.e., Th=approximately 12K) and defining the temperature Tc of the refrigerant before being introduced into the refrigeration means (i.e., Tc—4.2K), the temperature difference ΔT between the temperature Th and the temperature Tc assumes approximately 7.8K (i.e., 7.8K=12K=approximately 4.2K). When the temperature difference ΔT is defined as 100 percent, the active pressure drop type heat exchanger 23 declines the temperature of the refrigerant at the ratio of 90 percent out of 100 percent (7K/7.8K·100%≈90%).

Figure 4:
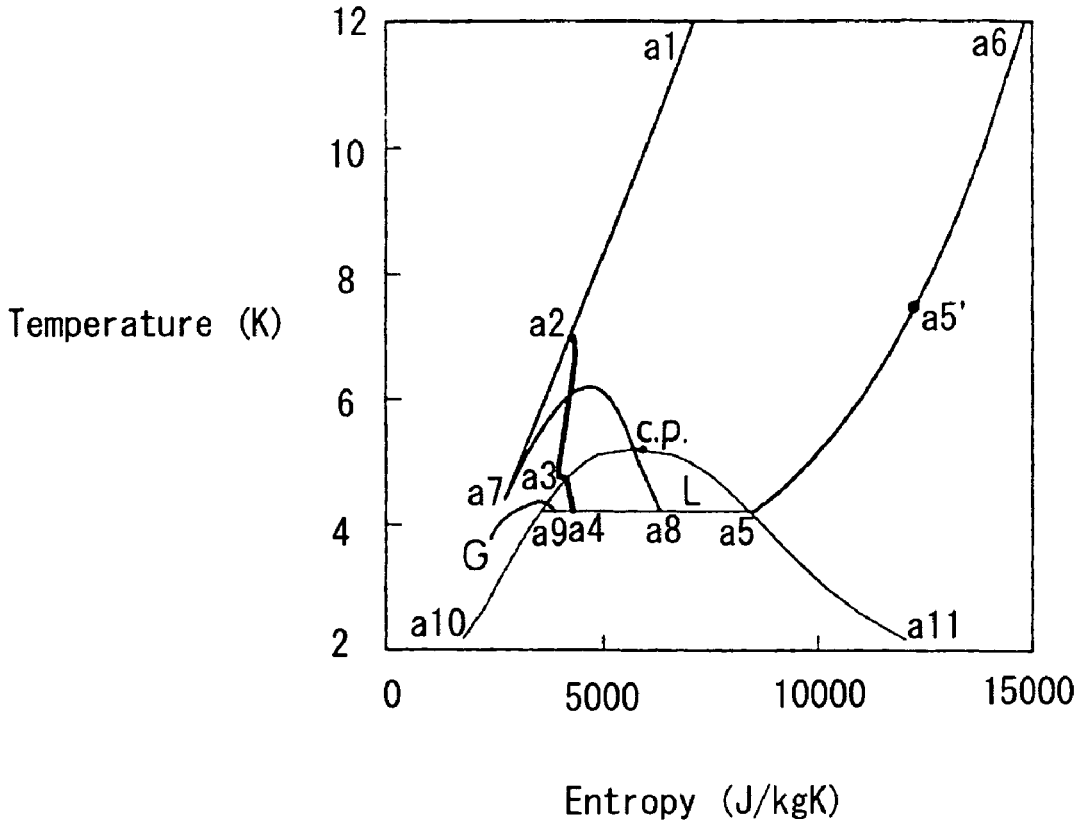
FIG. 4 is a graph showing a relationship between the entropy and the temperature of the refrigerant.

FIG. 4 shows the temperature-entropy phase diagram regarding the refrigerant (e.g., helium). A characteristics line a10-c.p.-a11 configured to be curved shown in FIG. 4 shows the phase border line of the coexisting region where the liquid phase and the gas phase of the refrigerant (e.g., helium) coexists. The characteristics line a9-a8-a5 shown in FIG. 4 shows 2-phase line at the pressure of 0.1 Mpa. With the 2-phase line, L shows the ratio of the liquid phase of the refrigerant and G shows the ratio of the gas phase of the refrigerant. A characteristics line a1-a2-a7 shows an isobar. A characteristics line a5-a5'-a6 shows an isobar.

According to the embodiment of the present invention, the high pressure gas of the refrigerant is refrigerated with the isopiestic state from a point al to a point a2 while maintaining an approximately constant pressure at 2.4 Mpa at the high pressure gas passage of the heat exchanger 23. Accordingly, the point a2 corresponds to an initial point of the pressure drop at the high pressure passage 231 of the heat exchanger 23. After the point a2, the pressure of the refrigerant of the high pressure passage 231 of the heat exchanger 23 continuously declines to 0.27 Mpa (shown in FIG. 2). Thus, the pressure gas of the refrigerant moves from the point a2 (i.e., the pressure of the refrigerant: 2.4 Mpa) to the point a3 (i.e., the pressure of the refrigerant: 0.27 Mpa). The point a3 corresponds to an outlet of the high pressure gas passage 231 of the heat exchanger 23.

As shown in FIG. 4, further, the refrigerant gas moves from the point a3 to the point a4. The refrigerant gas passes through the Joule-Thomson valve 24 while reducing the pressure so that the pressure at the point a4 assumes 0.1 Mpa. The refrigerant is liquefied at the point a4 and the refrigerant assumes the coexisting region of liquid helium and helium gas. In this case, the a4-a9 corresponds to the ratio of the gas phase of the refrigerant and the a4-a5 corresponds to the ratio of the liquid phase of the refrigerant. Thus the ratio of the helium gas with the weight ratio corresponds to approximately 20 percent and the ratio of the liquid helium assumes approximately 80 percent. According to the embodiment of the present invention, the refrigeration performance of the refrigeration means 25 can be increased because the ratio of the liquid helium corresponding to the refrigerant is increased. The refrigeration performance according to the embodiment assumes 17.6 W.

The liquid helium at the refrigeration means 25 moves from the point a4 to the point a5 while absorbing the heat of the body to be refrigerated. At the point a5, the all refrigerant corresponding to helium assume gas phase. Eventually, the temperature increases up to approximate to 12K after the refrigerant gas passes through a5-a6 while maintaining 0.1 Mpa.

As a comparison example, the case which does not show the pressure drop at the high pressure gas passage 231 of the heat exchanger 23 (i.e., corresponding to the characteristics line WA of FIG. 2) is shown. With the comparison example, as shown in FIG. 4, the high pressure gas of the refrigerant is refrigerated to a point 7 at the temperature of approximately 4.4.K via the points a1 and a2 with little pressure drop. The pressure is reduced along a7-a8 line by the Joule-Thomson valve 24. At the point a8, the refrigerant assumes coexisting region of the helium gas at 0.1 Mpa and liquid helium. In this case, because a8-a9 corresponds to the ratio of the gas phase of the refrigerant and a8-a5 corresponds to the ratio of liquid phase of the refrigerant, the ratio of the helium gas assumes 60 percent and the ratio of the liquid helium assumes 40 percent by weight ratio. With the comparison example, the ratio of the liquid helium is small. Likewise the embodiment, with the comparison example, the liquid helium absorbs the heat from the body 29 to be refrigerated and the temperature of the refrigerant increases to be equal to or higher than 10K along a5-a6 at the refrigeration means 25.

Although the pressure of the helium gas before being introduced into the high pressure passage 231 of the heat exchanger 23 (i.e., the pressure of the refrigerant at the hot end of the high pressure gas passage 231 of the heat exchanger 23) is determined to be 2.4 Mpa with the foregoing embodiment, the pressure of the helium gas is not limited and may be varied, for example, as 1.6 Mpa, 3.0 Mpa, or the like. Although the pressure of the refrigerant discharged from the high pressure gas passage 231 of the heat exchanger 23 (i.e., the pressure of the refrigerant at the cold end of the high pressure passage 231 of the heat exchanger 23) is determined to be 0.27 Mpa in the foregoing embodiment, the pressure of the refrigerant is not limited and may be varied, for example, 0.1 Mpa, 0.8 Mpa, or the like. According to the embodiment of the present invention, it is preferable to determine the pressure of the high pressure gas of the refrigerant at the cold end of the high pressure gas passage 231 of the heat exchanger 23 (i.e., the portion shown with an arrow W4 of FIG. 2) to be equal to or less than 0.85 Mpa. This is for using the refrigeration of the low pressure gas for refrigerating the high pressure gas.

The pressure drop at the high pressure gas passage 231 of the heat exchanger 23 is not limited to be equal to or greater than 2 Mpa. If the pressure drop at the high pressure gas passage 231 of the heat exchanger 23 is small, it is necessary to increase the pressure drop at the Joule-Thomson valve 24 and is necessary to reduce the passage diameter of the Joule-Thomson valve 24.

Although the temperature of the helium gas before being introduced into the high pressure gas passage 231 of the heat exchanger 23 (i.e., the temperature of the refrigerant at the hot end of the high pressure gas passage 231 of the heat exchanger 23) is determined to be 12K according to the embodiment of the present invention, the temperature is not limited and may be varied, for example, 8K, 16K, or the like. Although the temperature of the refrigerant discharged from high pressure gas passage 231 of the heat exchanger 23 (i.e., the pressure at the cold end of the high pressure gas passage 231 of the heat exchanger 23) is determined to be 4.21K according to the embodiment, the temperature is not limited and may be varied, for example, to be 2.5K, 4.5K, or the like. In case the temperature difference between the high pressure gas passage 231 and the low pressure gas passage 232 is greater than 0.2K at the hot end of the heat exchanger 23, the refrigeration performance may be declined.

Although the pressure difference ΔP between the pressure Ph and the pressure Pc is 2.3 Mpa and when the ΔP is defined as 100 percent, the active pressure drop type heat exchanger 23 declines the pressure of the refrigerant by the ratio of approximately 93 percent out of 100 percent, the ratio is not limited and may be varied so that the pressure of the refrigerant may be declined with the ratio equal to or greater than 80 percent out of 100 percent, equal to or greater than 60 percent out of 100 percent, equal to or greater than 40 percent out of 100 percent, or the like.

The pressure change of the refrigerant gas at the high pressure gas passage 231 of the active pressure drop type heat exchanger 23 is not limited as the state shown with the characteristic line W of FIG. 2 and may be varied so that the pressure of the refrigerant continuously declines from the hot end to the cold end of the high pressure gas passage 231 of the heat exchanger 23 as shown with a characteristic line W6 of FIG. 2, or the like.

With the main refrigeration circuit 1 formed with the Joule-Thomson circuit including the Joule-Thomson valve 24, it is preferable to determine the pressure of the refrigerant gas at the high pressure side to be 1.2–1.7 Mpa. In the meantime, the pressure of the refrigerant gas at the high pressure side at the pulse tube refrigerator 3 may be determined to be determined 2.0–3.0 Mpa, which is higher than the pressure of the refrigerant gas at the high pressure side at the main refrigeration circuit 1. Further, according to the embodiment of the present invention, as shown in FIG. 1, the compressor portion 11 is shared between the main refrigeration circuit 1 and the pulse tube refrigerator 3 serving as the pre-cooling refrigerator and the refrigerant discharged from the high pressure gas port 13 of the compressor portion 11 is supplied to the high pressure passage 1*a* of the main refrigeration circuit 1 and the high pressure passage 3*a* of the pulse tube refrigerator 3.

With the construction sharing the compressor portion 11 between the main refrigeration circuit 1 and the pre-cooling refrigerator, it is preferable that the pressure of the refrigerant discharged from the high pressure gas port 13 of the compressor portion 11 is complied with the appropriate refrigerant pressure of the high pressure passage 3*a* at the pulse tube refrigerator 3. Accordingly, the pressure of the refrigerant gas discharged from the high pressure gas port 13 of the compressor portion 11 is determined to be equal to or greater than 2 Mpa (e.g., 2.4 Mpa). The pressure at the high pressure side of the refrigerant gas complied with the pulse tube refrigerant 3 is excessively high for the main refrigeration circuit 1 formed with the Joule-Thomson circuit. Because the pressure of the refrigerant gas discharged from the high pressure gas port 13 of the compressor portion 11 is determined to be equal to or greater than 2 Mpa, which is relatively high, it is advantageous for significantly declining the pressure of the refrigerant gas at the active pressure drop type heat exchanger 23.

Variations of the active pressure drop type heat exchanger 23 will be explained with reference to FIGS. 5–15 as follows. The heat exchanger shown in FIGS. 5–15 shows the heat exchanger portion of the region W2 for declining the pressure of the refrigerant gas shown in FIG. 2.

Figure 5:
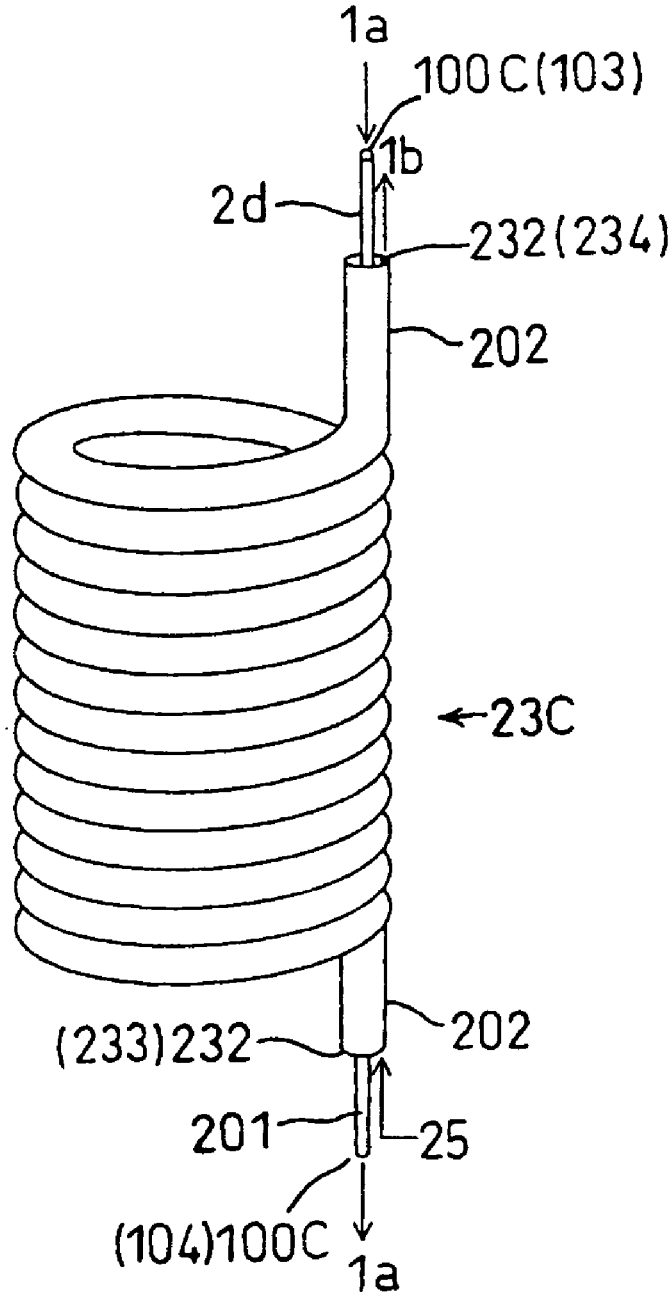
FIG. 5 is a perspective view showing a main portion of an active pressure drop type heat exchanger according to a first example.

A first example of the variations of the active pressure drop type heat exchanger 23 is shown in FIG. 5. An active pressure drop type heat exchanger 23C includes a first pipe 201 made of metal with relatively small diameter and having a pressure drop passage 100C in communication with the high pressure passage 1*a* and a second pipe 202 made of metal and having relatively large diameter. The active pressure drop type heat exchanger 23C is formed by inserting the first pipe 201 including the pressure drop passage 100C to locate in the second pipe 202 and by winding the second pipe 202 spirally along with the first pipe 201. The pressure drop passage 100C corresponds to the high pressure gas passage 231.

The diameter of the pressure drop passage 100C corresponding to the internal diameter of the first pipe 201 may be determined to be 0.1–15 millimeters, 0.1–5 millimeters, and 0.2–2 millimeters, or the like. The length of the pressure drop passage 100 may be determined to be 0.1–200 meters, 0.2–200 meters, 0.2–2 meters, or the like depending on the internal diameter of the first pipe 201.

A clearance between the first pipe 201 and the second pipe 202 is defined as the low pressure gas passage 232 in communication with the low pressure passage 1*b*, The pressure drop passage 100C includes a high pressure gas inlet 103 and a high pressure gas outlet 104. The low pressure gas passage 232 includes a low pressure gas inlet 233 and a low pressure gas outlet 234. The high pressure gas introduced at the pressure drop passage 100C is refrigerated by exchanging the heat with the low pressure gas (i.e., heat exchange medium) of the refrigerant returned from the refrigeration means 25 and introduced at the low pressure gas passage 232 with the low temperature. With the active pressure drop type heat exchanger 23C, the refrigerant introduced at the pressure drop passage 100C can be refrigerated while significantly declining the pressure of the refrigerant introduced at the pressure drop passage 100C for attaining the active pressure drop type heat exchanger according to the embodiment of the present invention. Because the heat exchanger 23C includes the spiral configuration, the axial length of the heat exchanger 23C can be shortened.

A second example of the variations of the active pressure drop type heat exchanger 23 will be explained with reference to FIGS. 6–7. An active pressure drop type heat exchanger 23D includes a spiral tube 204D serving as a passage forming member formed by multiply winding a pipe including a pressure drop passage 100D in communication with the high pressure passage 1*a* spirally and a base body 236D including a low pressure gas passage 232D for accommodating the spiral tube 204D. The pressure drop passage 100D includes a high pressure gas inlet 103 and a high pressure gas outlet 104. The base body 236D includes a low pressure gas inlet 233 where the low pressure gas with the low temperature returned from the refrigeration means 25 is introduced and a low pressure gas outlet 234.

Figure 7A:
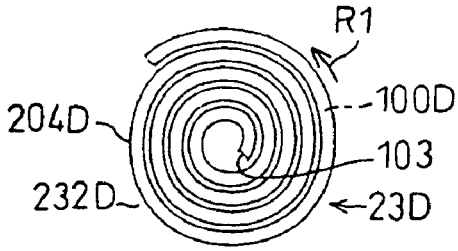
FIG. 7 shows a spiral tube included in the active pressure drop type heat exchanger of the second example.

As shown in FIG. 7A, the gas introduced from the high pressure gas inlet 103 positioned at the internal side of the spiral tube 204D to the pressure drop passage 100D flows from the center of the spiral tube 204D towards the external periphery in the direction of an arrow R1.

Figure 7B:
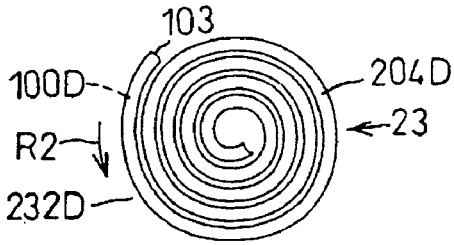
Figure 7C:
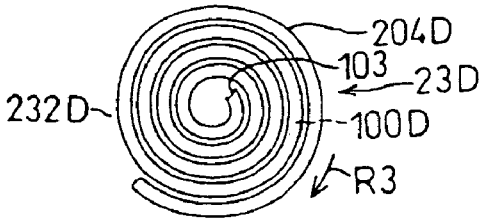

As shown in FIG. 7B, the refrigerant is introduced from the high pressure gas inlet 103 at the external side of the spiral tube 204D to the pressure drop passage 100D to be introduced from the external peripheral side of the spiral tube 204D towards the center in the direction of an arrow R2. Further as shown in FIG. 7C, the refrigerant is introduced from the high pressure gas inlet 103 at the internal side of the spiral tube 204D to the pressure drop passage 100D to be introduced from the center of the spiral tube 204D to the external peripheral side in the direction of an arrow R3.

The length of the passage of the pressure drop passage 100D can be increased while restraining the increase of the length L of the base body 236D by alternately positioning the spiral passage introduced from the center to the external peripheral side in the spiral tube 204D and the spiral passage introduced from the external peripheral side to the center in the spiral tube 204D. The diameter of the pressure drop passage 100D may be determined 0.1–5 millimeters, or the like and the length of the pressure drop passage 100D may be determined 1–200 meters, or the like.

The high pressure gas introduced at the pressure drop passage 100D is refrigerated by exchanging ht heat with the low pressure gas (heat exchange medium) introduced at the low pressure gas passage 232D with the low temperature returned from the refrigeration means 25.

Figure 6:
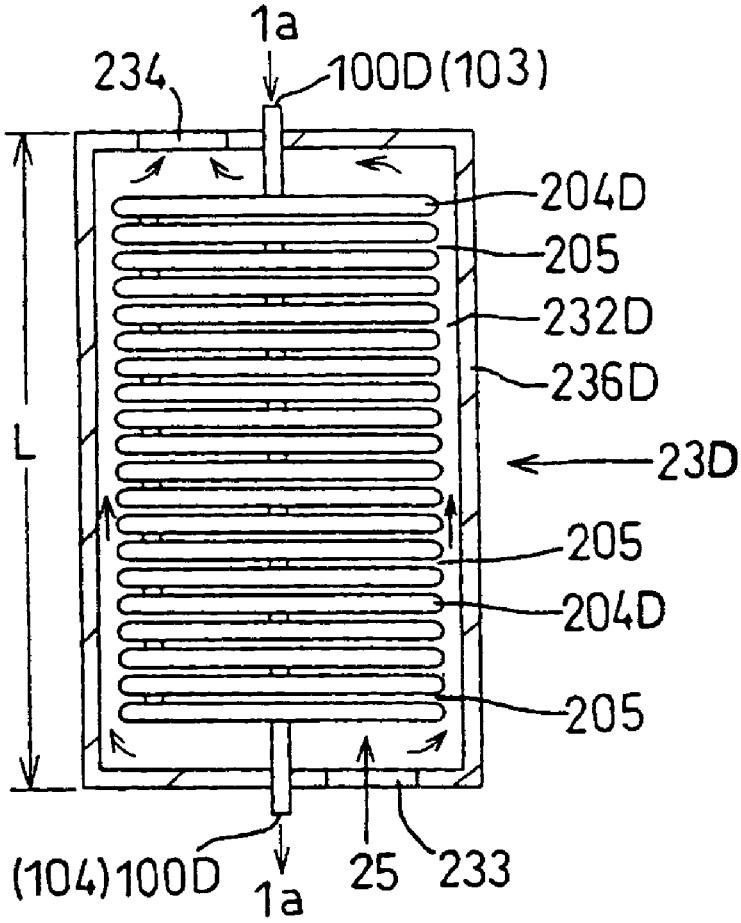
FIG. 6 is a cross-sectional view showing an active pressure drop type heat exchanger according to a second example.

As shown in FIG. 6, a passage 205 introduced with the low pressure gas is formed between spiral tubes 204D arranged to be adjacent in piling direction in order to increase the heat exchange performance.

With the active pressure drop type heat exchanger 23D, the refrigerant introduced at the pressure drop passage 100D can be refrigerated while significantly declining the pressure of the refrigerant introduced at the pressure drop passage 100D, for attaining the active pressure drop type heat exchanger according to the embodiment of the present invention.

Figure 8:
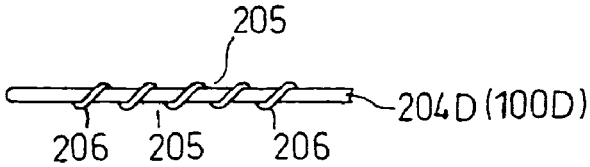
FIG. 8 shows a spacer member attached at the spiral tube.

As shown in FIG. 8, a spacer member 206 having wire configuration with small diameter may be wound around an external peripheral surface of the pipe which forms the spiral tube 204D. In this case, because the spacer member 206 is provided, the passage 205 where the low pressure gas flows is likely to be formed between the spiral tubes 204D adjacent each other in the piling direction, which increases the heat exchange performance. The spacer member 206 may be made of metal such as copper with favorable heat transmission. The spacer member 206 may include projections at the external peripheral surface of the spiral tube 204.

Figure 9:
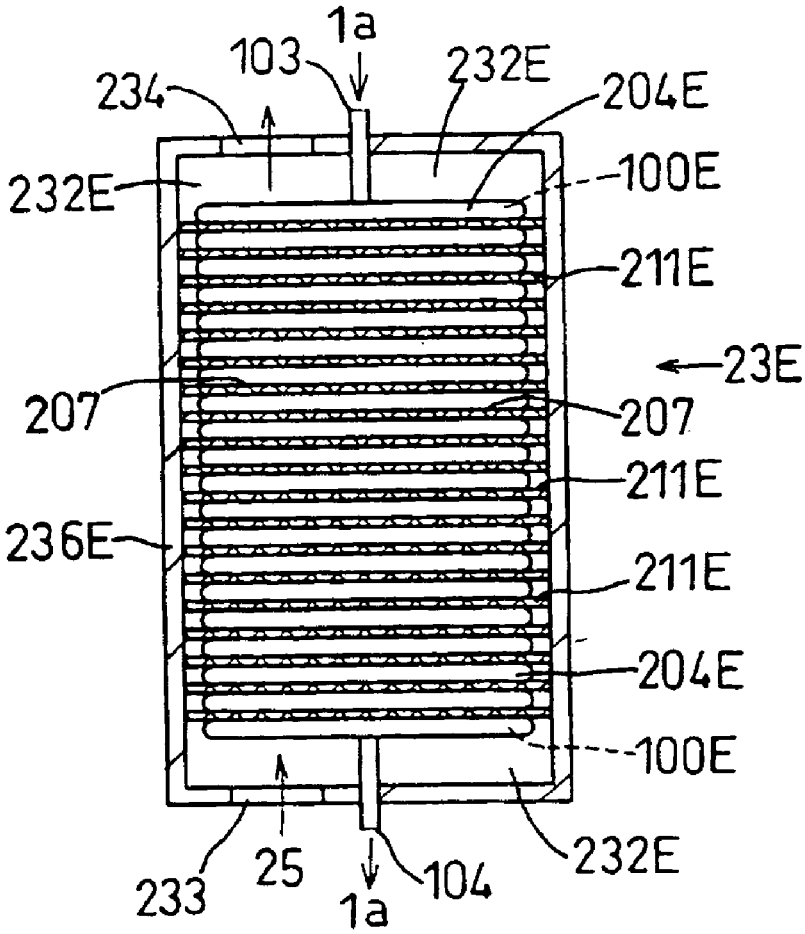
FIG. 9 shows an active pressure drop type heat exchanger according to a third example.

A third example of the variation of the active pressure drop type heat exchanger will be explained with reference to FIG. 9. As shown in FIG. 9, an active pressure drop type heat exchanger 23E includes a spiral tube 204E formed by winding a pipe including a pressure drop passage 100E in communication with the high pressure passage 1*a* spirally, multiply, and continuously, a mesh member 211E made of metal such as copper having the favorable heat transmission performance and provided between the spiral tubes 204E, and a base body 236E including a low pressure gas passage 232E for accommodating the spiral tube 204E and the mesh member 211E. The low pressure gas with the low temperature returned from the refrigeration means 25 flows in the low pressure gas passage 232E. The diameter of the pressure drop passage 100E may be determined to be 0.1–5 miliimeters, or the like. The length of the pressure drop passage 100E may be determined to be 1–200 meters, 5–100 meters, and 5–50 meters, or the like.

The pressure drop passage 100E includes a high pressure gas inlet 103 and a high pressure gas outlet 104. The base body 236E includes a low pressure gas inlet 233 where the low pressure gas with the low temperature returned from the refrigeration means 25 is introduced and the low pressure gas outlet 234.

The gas introduced from the high pressure gas inlet 103 of the spiral tube 204E to the pressure drop passage 100E is discharged from the high pressure gas outlet 104. In this case, the high pressure gas introduced into the pressure drop passage 100E is refrigerated by exchanging the heat with the low pressure gas with the low temperature introduced at the low pressure gas passage 232E. A passage 207 where the low pressure gas flows is formed with mesh member 211E between the spiral tubes 204 adjacent each other in the piling direction. Because the mesh member 211E is made of metal having the favorable heat transfer performance such as copper, the heat exchanger performance is increased by the gas passing through the mesh.

With the active pressure drop type heat exchanger 23E, the refrigerant introduced at the pressure drop passage 100E can be refrigerated while significantly declining the refrigerant introduced at the pressure drop passage 100E for attaining the active pressure drop type heat exchanger, according to the embodiment of the present invention.

Figure 10:
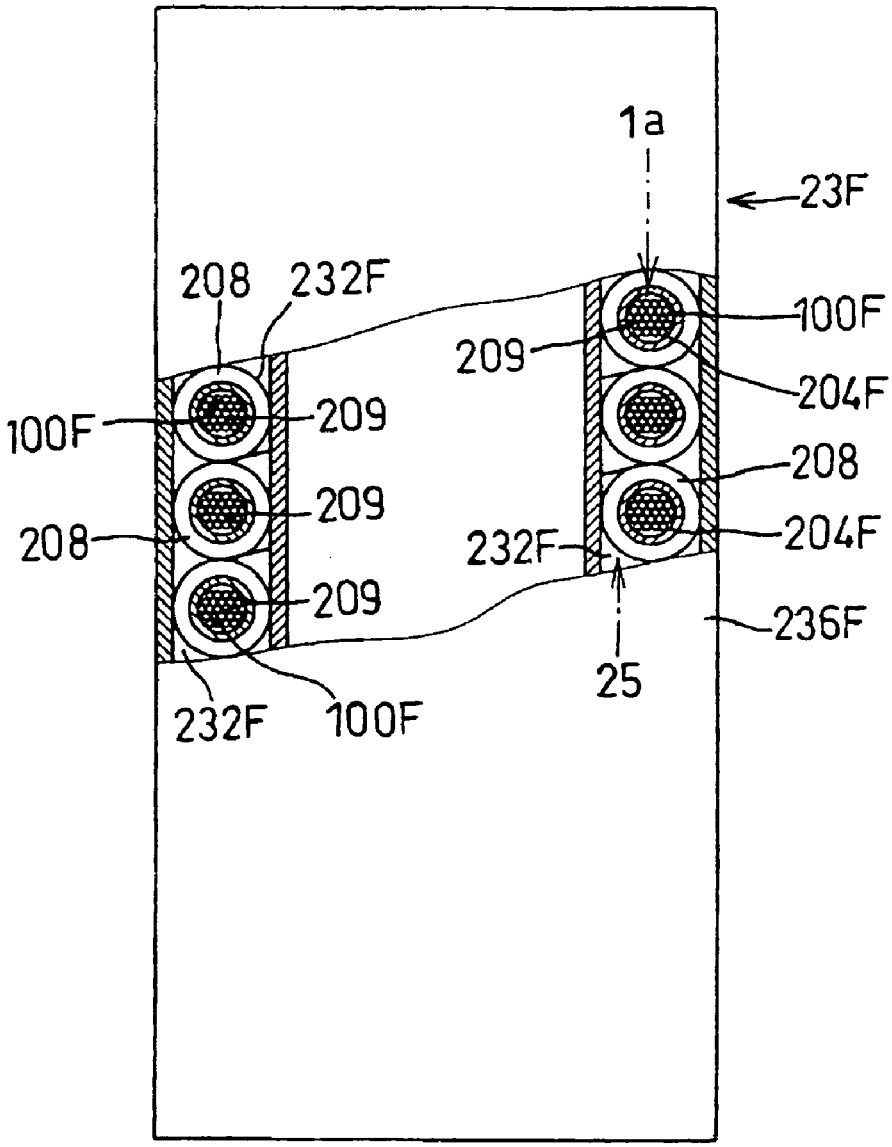
FIG. 10 shows an active pressure drop type heat exchanger according to a fourth example.

A fourth example of the variations of the active pressure drop type heat exchanger 23 will be explained with reference to FIG. 10. As shown in FIG. 10, an active pressure drop type heat exchanger 23F includes a spiral tube 204F formed by spirally, multiply, and continuously winding a pipe including a pressure drop passage 100F in communication with the high pressure passage 1*a* and a base body 236F including a low pressure passage 232F for accommodating the spiral tube 204F. A fin 208 for accelerating the heat exchange is provided at an external peripheral surface of the pipe for forming the spiral tube 204F. The fin 208 is made of metal such as copper having the favorable thermal conductivity. By stuffing a number of resistors 209 into the pipe for forming the spiral tube 204F, the pressure drop passage 100F is configured to have porous. The resistor 209 is made of metal such as copper having the favorable thermal conductivity and includes the resistance against the flow of the refrigerant gas. The resistor 209 may be spherically configured. By changing the size of the resistor 209, the degree of the pressure drop of the pressure drop passage 100F can be adjusted. The diameter of the pressure drop passage 100F may be determined to be 0.01–3 millimeters, or the like. The length of the pressure drop passage 100F may be determined to be 0.1–200 meters, or the like.

The low pressure gas at the low temperature returned from the refrigeration means 25 flows in the low pressure gas passage 232F. In this case, the gas with the high pressure introduced at the pressure drop passage 100F is refrigerated by exchanging the heat by the low pressure gas at the low temperature of the low pressure gas passage 232F.

As shown in FIG. 10, the heat exchange is further accelerated by the fin 208 for the heat exchange acceleration formed at the pipe. As the resistor 209, formed in the spherical configuration, Or the like, is made of metal such as copper having the favorable thermal conductivity, the pressure drop of the pressure drop passage 100F can be increased and the heat exchange performance is increased.

With the heat exchanger 23F, the refrigerant introduced at the pressure drop passage can be refrigerated while significantly declining the pressure of the refrigerant introduced at the pressure drop passage 100F for attaining the active pressure drop type heat exchanger according to the embodiment of the present invention.

A fifth example of the variation of the active pressure drop type heat exchanger 23 will be explained with reference to FIG. 11 as follows.

Figure 11:
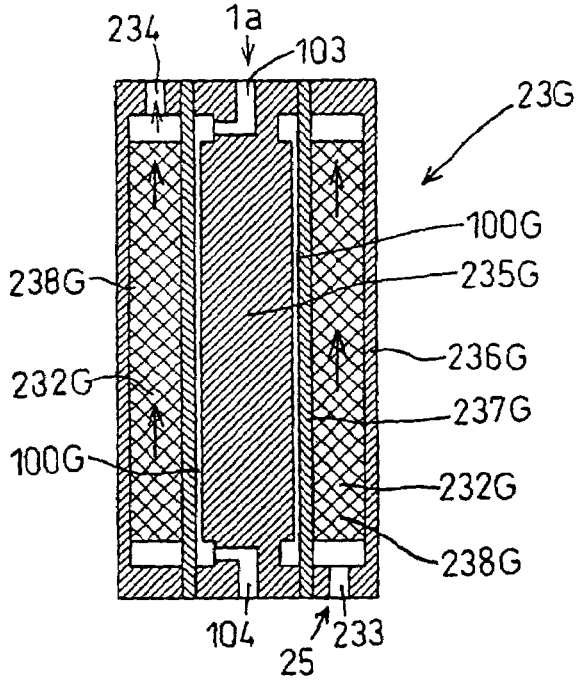
FIG. 11 shows an active pressure drop type heat exchanger according to a fifth example.

An active pressure drop type heat exchanger 23G shown in FIG. 11 includes an outer cylindrical base body 236G, an inner cylinder 237G serving as an internal member provided in the base body 236G, a passage forming member 235G configured to be pillar provided in the inner cylinder 237G, and a heat transfer acceleration member 238G provided in a low pressure gas passage 232G provided between the base body 236G and the inner cylinder 237G. The heat transfer acceleration member 238G made of metal such as copper having the favorable thermal conductivity is configured to be meshed for forming a passage. A ring configured pressure drop passage 1000 is formed with an internal peripheral surface of the inner cylinder 237G and an external peripheral surface of the passage forming member 235G. The pressure drop passage 100G includes a high pressure gas inlet 103 formed at the passage forming member 235G and a high pressure gas outlet 104. The base body 236G includes a low pressure gas inlet 233 and a low pressure gas outlet 234.

The high pressure gas introduced from the high pressure gas inlet 103 of the pressure drop passage 100G is discharged from the high pressure gas outlet 104. The low pressure gas at the low temperature returned from the refrigeration means 25 is introduced from the low pressure gas inlet 233 to the low pressure gas passage 232G to be discharged from the low pressure gas outlet 234. In this case, the high pressure gas introduced to the pressure drop passage 100G is refrigerated by exchanging the heat with the low pressure gas at the low temperature introduced in the low pressure gas passage 232G. The heat exchange performance is further accelerated by the heat transfer acceleration member 238G. With the heat exchanger 23G, the refrigerant introduced at the pressure drop passage 100G can be refrigerated while significantly declining the pressure of the refrigerant introduced at the pressure drop passage 100G, for attaining the active pressure drop type heat exchanger according to the embodiment of the present invention.

Figure 12:
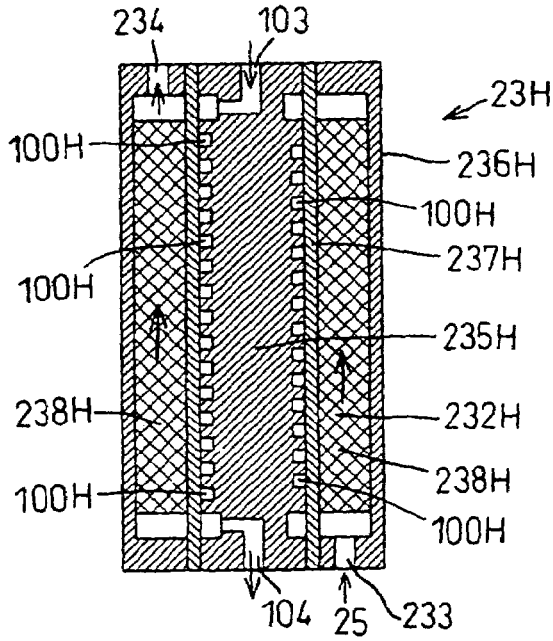
FIG. 12 shows an active pressure drop type heat exchanger according to a sixth example.

A sixth example of the variation of the active pressure drop type heat exchanger 23 will be explained with reference to FIG. 12. As shown in FIG. 12, an active pressure drop type heat exchanger 23H includes an outer cylindrical base body 236H, an inner cylinder 237H provided in the base body 236H, a pillar configured passage forming member 235H provided in the inner cylinder 237H, and a heat transfer acceleration member 238H provided in a low pressure gas passage 232H provided between the base body 236H and the inner cylinder 237H. The heat transfer acceleration member 238H made of metal such as copper having the favorable thermal conductivity is configured to be mesh for forming a passage.

A spirally grooved pressure drop passage 100H is continuously formed at an external peripheral surface of the passage forming member 235H. The pressure drop passage 100H includes a high pressure gas inlet 103 formed at the passage forming member 235H and a high pressure gas outlet 104. The base body 236H includes a low pressure gas inlet 233 in communication with the low pressure gas passage 232H and a low pressure gas outlet 234.

The high pressure gas introduced from the high pressure gas inlet 103 of the pressure drop passage 100H to the pressure drop passage 100H is discharged from the high pressure gas outlet 104. The low pressure gas at the low temperature returned from the refrigeration means 25 is introduced from the low pressure gas inlet 233 to the low pressure gas passage 232H to be discharged from the low pressure gas outlet 234. In this case, the high pressure gas introduced into the pressure drop passage 100H is refrigerated by exchanging the heat with the low pressure gas at the low temperature introduced at the low pressure gas passage 232H. The heat exchange performance is accelerated by a heat transfer acceleration member 238H. With the heat exchanger 23H, the refrigerant introduced at the pressure drop passage 100H can be refrigerated while significantly declining the pressure of the refrigerant introduced at the pressure drop passage 100H for attaining the active pressure drop type heat exchanger according to the embodiment of the present invention.

Figure 13:
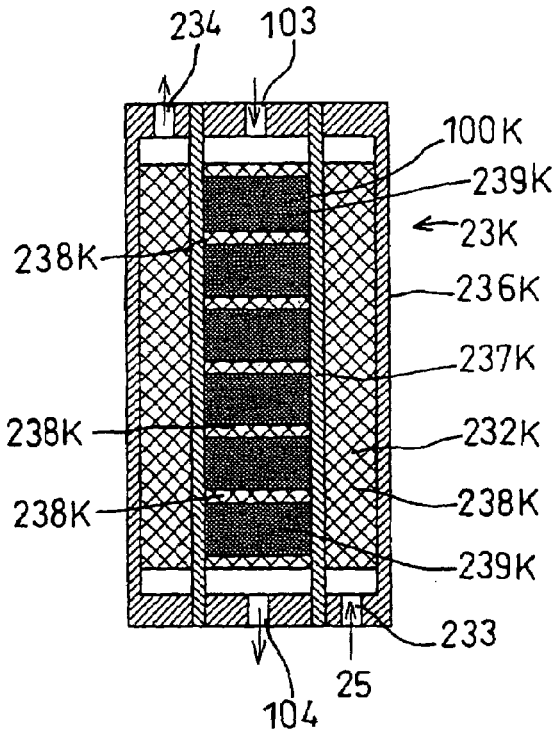
FIG. 13 shows an active pressure drop type heat exchanger according to a seventh example.

A seventh example of the variation of the active pressure drop type heat exchanger 23 will be explained with reference to FIG. 13. As shown in FIG. 13, an active pressure drop type heat exchanger 23K includes an outer cylindrical base body 236K, an inner cylinder 237K serving as an internal member provided in the base body 236K, a porous body 239K provided in the inner cylinder 237K for forming a pressure drop passage 100K with small bore, and a heat transfer acceleration member 238K provided in a low pressure gas passage 232K provided between the base body 236K and the inner cylinder 237K The heat transfer acceleration member 238K made of metal such as copper having the favorable thermal conductivity is configured to be mesh for forming a passage. In this case, K shown in FIG. 13 corresponds to a part of each numeral.

The plural porous bodies 239K are arranged in series to be piled maintaining a predetermined interval. The heat transfer acceleration member 238K is positioned between the porous bodies 239K adjacent to each other in the piling direction. The heat transfer acceleration member 238K made of metal such as copper having the favorable thermal conductivity is configured to be mesh for forming a passage.

The high pressure gas introduced from a high pressure gas inlet 103 to the pressure drop passage 100K is discharged from a high pressure gas outlet 104. The low pressure gas at the low temperature returned from the refrigeration means 25 flows from the low pressure gas inlet 233 to the low pressure gas passage 232K to be discharged from the low pressure gas outlet 234. In this case, the high pressure gas introduced into the pressure drop passage 100K is refrigerated by exchanging the heat with the low pressure gas at the low temperature introduced at the low pressure gas passage 232K The heat transfer acceleration member 238 further accelerates the heat exchange performance. With the heat exchanger 23K, the refrigerant introduced at the pressure drop passage 100K can be refrigerated while significantly declining the pressure of the refrigerant introduced at the pressure drop passage 100K, for attaining the active pressure drop type heat exchanger according to the embodiment of the present invention.

Figure 14:
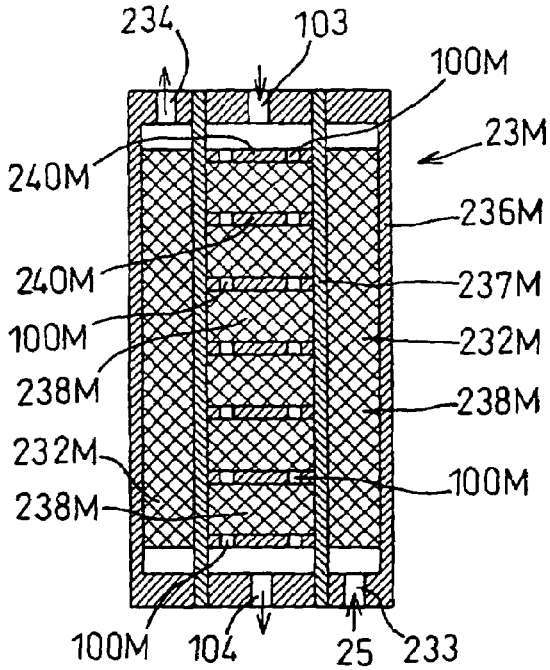
FIG. 14 shows an active pressure drop type heat exchanger according to an eighth example.

An eighth example of the variation of the active pressure drop type heat exchanger 23 will be explained with reference to FIG. 14. An active pressure drop type heat exchanger 23M shown in FIG. 14 includes an outer cylindrical base body 236M, an inner cylinder 237M provided in the base body 236M, a plurality of plate members 240M including a penetration bore with small diameter for forming a pressure drop passage 100M, and a heat transfer acceleration member 238M provided in a low pressure gas passage 232M provided between the base body 236M and the inner cylinder 237M. The heat transfer acceleration member 238M made of metal such as copper having the favorable thermal conductivity is configured to be mesh for forming a passage.

The plural plate members 240M are arranged in series in the inner cylinder 237M maintaining the predetermined interval from each other. The heat transfer acceleration member 238M is positioned between the plate members 240M adjacent each other in the arranged direction. The heat transfer acceleration member 238M made of metal such as copper having the favorable thermal conductivity is configured to be mesh for forming a passage.

The high pressure gas introduced from a high pressure gas inlet 103 to the pressure drop passage 100M is discharged from a high pressure gas outlet 104. The low pressure gas at the low temperature returned from the refrigeration means 25 is introduced from a low pressure gas inlet 233 to the low pressure gas passage 232M to be discharged from a low pressure gas outlet 234. In this case, the high pressure gas introduced into the pressure drop passage 100M is refrigerated by exchanging the heat with the low pressure gas introduced in the low pressure gas passage 232. The heat transfer acceleration member 238M further accelerates the heat exchange. With the heat exchanger 23M, the refrigerant introduced at the pressure drop passage 100M can be refrigerated while significantly declining the pressure of the refrigerant introduced at the pressure drop passage 100M for attaining the active pressure drop type heat exchanger according to the embodiment of the present invention.

Figure 15:
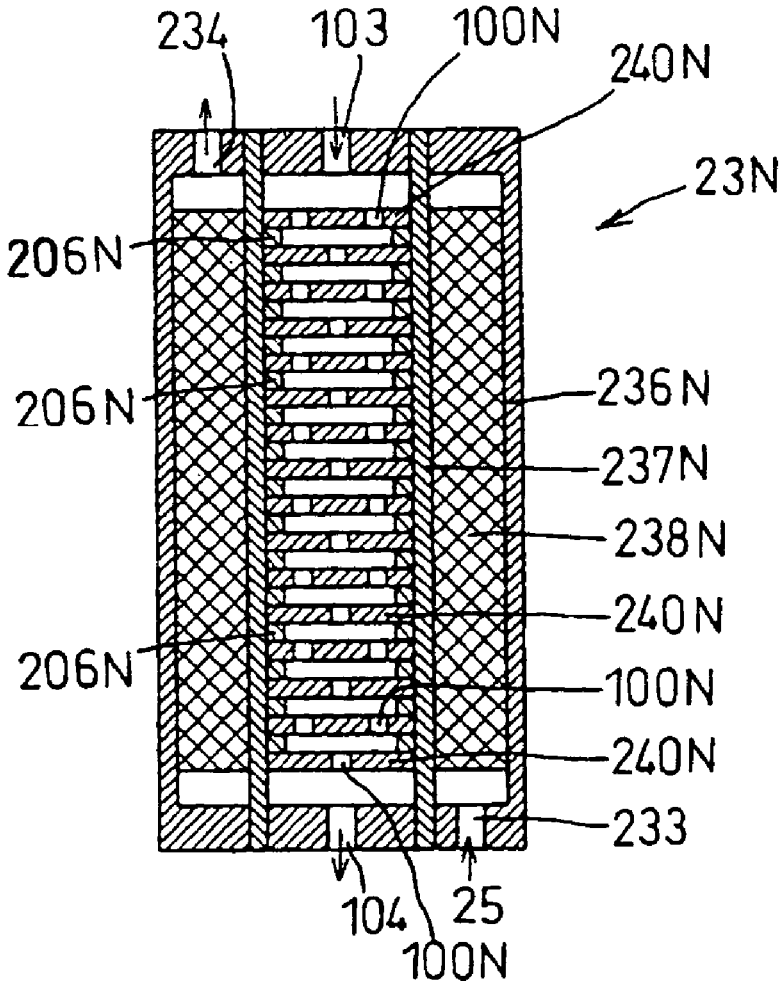
FIG. 15 shows an active pressure drop type heat exchanger according to a ninth example.

A ninth example of the variation of the active pressure drop type heat exchanger will be explained with reference to FIG. 15. As shown in FIG. 15, an active pressure drop type heat exchanger 23N includes an outer cylindrical base body 236N, an inner cylinder 237N provided in the base body 236N, a plurality of plate members 240N including a penetration bore with small diameter piled for forming a pressure drop passage 100N in the inner cylinder 237, and a heat transfer acceleration member 238N provided in a low pressure gas passage 232N provided between the base body 236N and the inner cylinder 237N. The heat transfer acceleration member 238N made of metal such as copper having the favorable thermal conductivity is configured to be mesh. The plurality of plate members 240N are arranged in series in the inner cylinder 237N piled maintaining the predetermined interval from each other. A spacer member 206N is positioned between plate members 240N adjacent from each other in the piling direction. The spacer 206N is made of metal such as copper having the favorable thermal conductivity.

The high pressure gas introduced from the high pressure gas inlet 103 to the pressure drop passage 100N is discharged from the high pressure gas outlet 104. In this case, the high pressure gas introduced into the pressure drop passage 100N is refrigerated by the heat exchange by the low pressure gas introduced in the low pressure gas passage 232N. The heat exchange is further accelerated by the heat transfer acceleration member 238N. With the heat exchanger 23N, the refrigerant introduced at the pressure drop passage 100N can be refrigerated while significantly declining the pressure of the refrigerant introduced in the pressure drop passage 100N for attaining the active pressure drop type heat exchanger according to the embodiment of the present invention.

With the examples of the active pressure drop type heat exchanger shown in FIGS. 11–15, the internal diameter of the outer cylindrical base body may be determined to be 20–200 millimeters, or the like. An internal diameter of the inner cylinder may be determined to be 10–100 millimeters, or the like.

A second embodiment, a third embodiment, and a fourth embodiment will be explained with reference to FIGS. 16–18 respectively as follows. The second through fourth embodiments of the present invention include the construction likewise the first embodiment and include the operational effect likewise the first embodiment. With the second through fourth embodiments, likewise the first embodiment, the active pressure drop type heat exchanger 23 refrigerates the refrigerant while actively declining the pressure of the refrigerant with the ratio of equal to or greater than 5 percent out of 100 percent, when the pressure difference between the pressure Ph of the refrigerant before being introduced into the active pressure drop type heat exchanger 23 and the pressure Pc of the refrigerant before being introduced into the refrigeration means are defined to be 100 percent.

Figure 16:
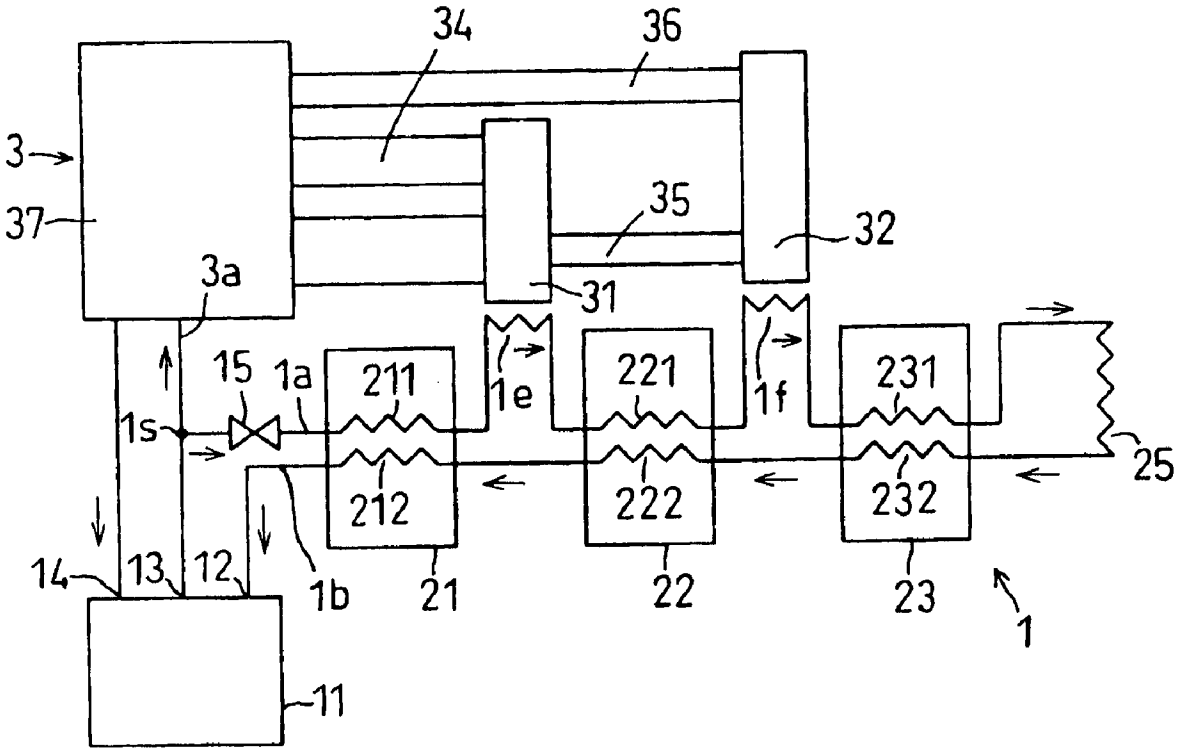
FIG. 16 is an overview showing an active pressure drop type heat exchanger according to a second embodiment of the present invention.

According to the second embodiment shown in FIG. 16, the Joule-Thomson valve 24 at the low temperature side provided in the first embodiment is not provided and the valve 15 positioned at normal temperature region is provided. The valve 15 positioned at the high temperature side may be determined to have the pressure reduction function that the Joule-Thomson valve 24 at the low temperature side has in the first embodiment. Because the valve 15 at the high temperature side is positioned in the normal temperature region, the operational performance is favorable and the maintenance of the valve 15 is easy even at the problems such as the clogging. With the construction of the second embodiment, the problems of the clogging at the Joule-Thomson valve 24 at the low temperature side can be solved because the Joule-Thomson valve 24 is not provided in the second embodiment.

Figure 17:
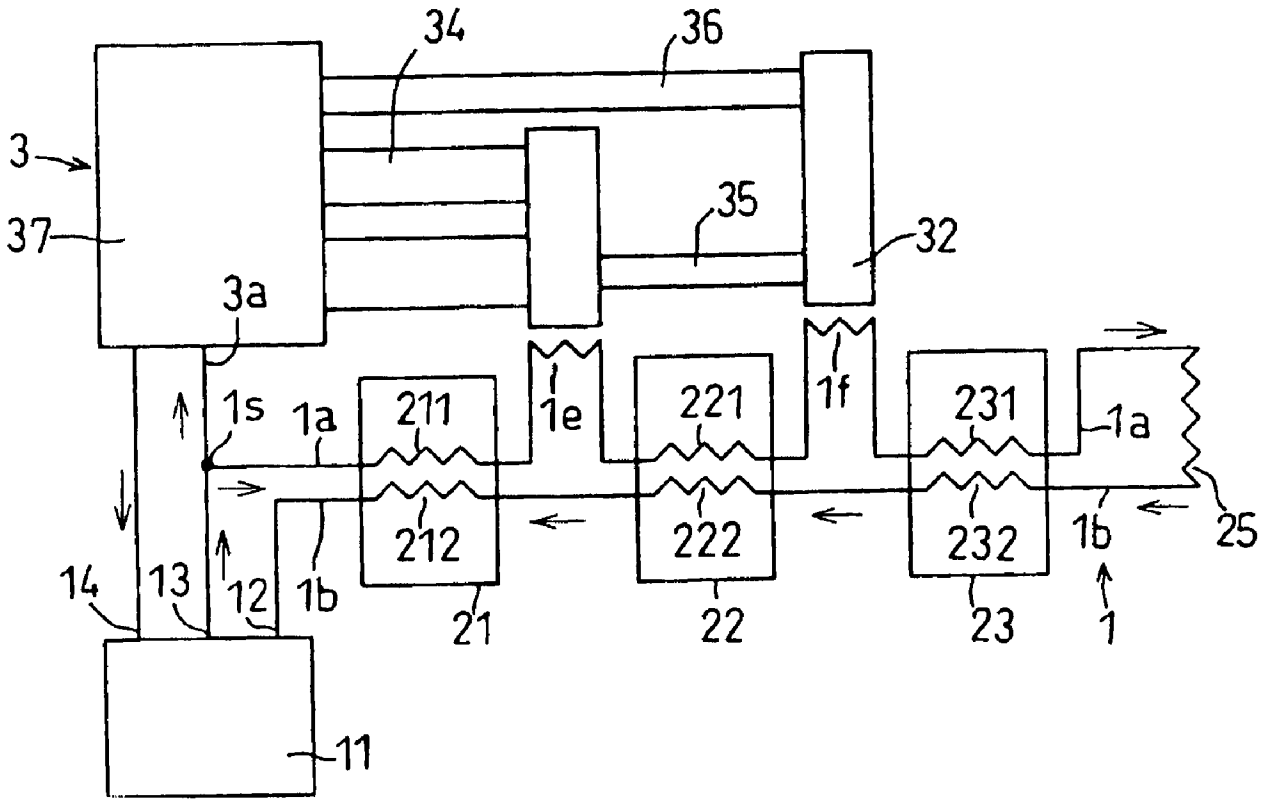
FIG. 17 is an overview showing an active pressure drop type heat exchanger according to a third embodiment of the present invention.

According to the third embodiment shown in FIG. 17, the Joule-Thomson valve 24 at the low temperature side and the valve 15 at the high temperature side are not provided. Because the Joule-Thomson valve 24 at the low temperature side is not provided, the problems caused by the clogging, or the like, at the Joule-Thomson valve 24 can be solved. It is necessary to ensure the pressure drop of the refrigerant at the last heat exchanger 23 positioned immediately before the refrigeration means 25 with the construction that the Joule-Thomson valve 24 at the low temperature side is not provided.

Figure 18:
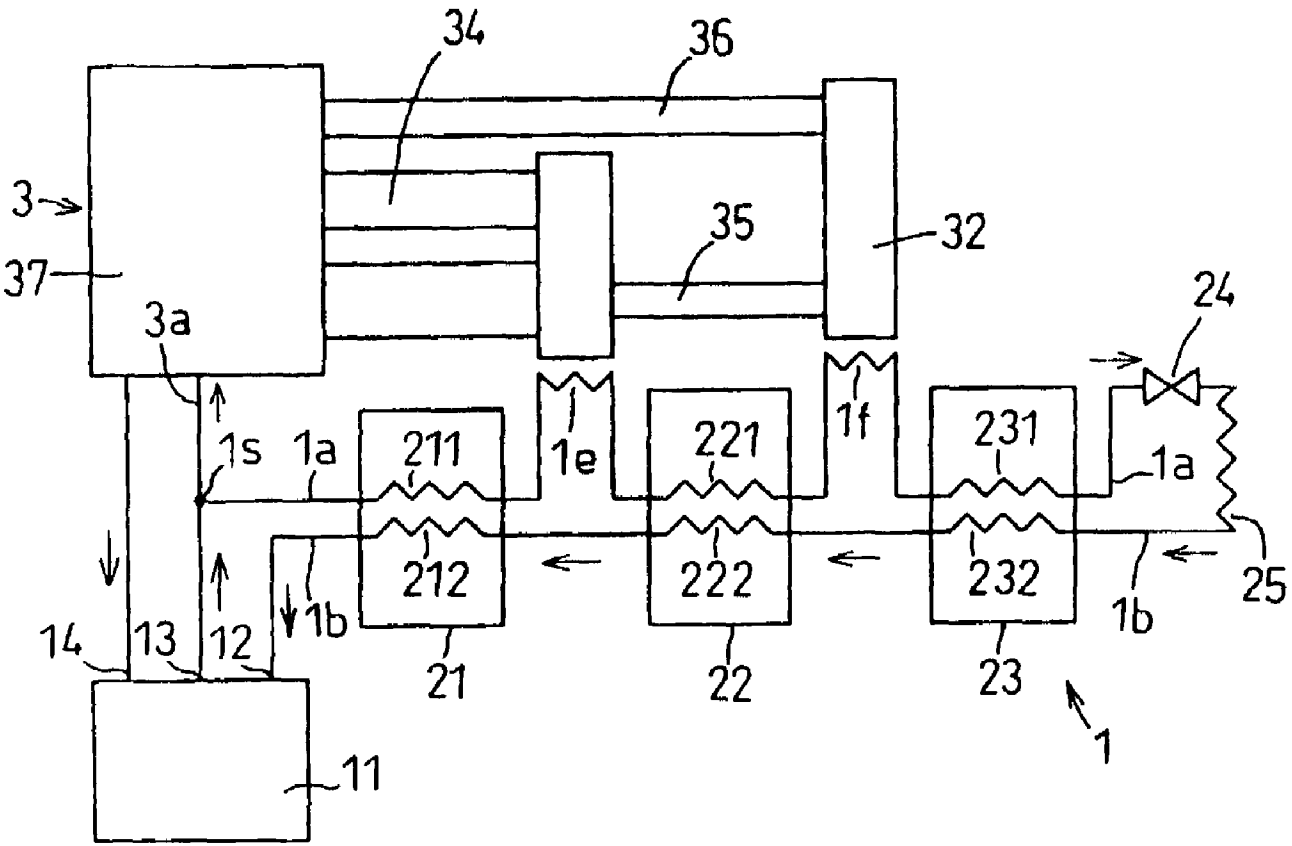
FIG. 18 is an overview showing an active pressure drop type heat exchanger according to a fourth embodiment of the present invention.

According to the fourth embodiment shown in FIG. 18, the Joule-Thomson valve 24 at the low temperature side is provided and the valve 15 at the high temperature side is not provided.

Although the compressor portion 11 serving as the pressure feeding means is shared between the main refrigerant circuit 1 and the pulse tube refrigerator 3 serving as the pre-cooling refrigerator with the foregoing embodiments, the construction is not limited. Separated compressors including a first compressor for the main refrigeration circuit 1 and a second compressor for the pre-cooling refrigerator. The pulse tube refrigerator 3 may be one stage type or three stage type, or the like. Although the pulse refrigerator 3 is used as the pre-cooling refrigerator in the foregoing embodiments, the variation of the pre-cooling refrigerator is not limited. The pre-cooling refrigerator may include Gifford McMahon type cryogenic refrigerator, Solvay type cryogenic refrigerator, Vuilleumier refrigerator, and Stirling type cryogenic refrigerator, or the like.

Although the heat exchangers 21, 22, 23 are provided at the high pressure passage 1*a*, the number of the heat exchanger is not limited. The heat exchangers 22, 23 may be provided or the heat exchanger 23 may be provided depending On the usage of the cryogenic refrigerator.

According to the embodiment of the present invention, the cryogenic refrigerator includes the active pressure drop type heat exchanger positioned approximate to the refrigeration means for actively declining the pressure of the refrigerant at the high pressure passage before being introduced into the refrigeration means, Thus, the construction of the cryogenic refrigerator according to the embodiment of the present invention is different from the cryogenic refrigerators which are designed to reduce the pressure drop when the refrigerant flows as little as possible.

According to the embodiment of the present invention, the active pressure drop type heat exchanger declines the pressure of the refrigerant at the ratio of equal to or greater than 5 percent out of 100 percent and refrigerates the refrigerant when the pressure difference between the pressure Pc of the refrigerant before being introduced into the refrigeration means and the pressure Ph of the refrigerant before being introduced into the active pressure drop type heat is defined as 100 percent. Accordingly, it is advantageous for attaining the cryogenic temperature at the refrigeration means and the liquefaction ratio of the refrigerant such as helium, nitrogen, neon, argon, carbon dioxide, methane, ethane, propane, butane, various fluorocarbons, hydrogen, oxygen, and mixture thereof can be increased.

The principles, preferred embodiment and mode of operation of the present invention have been described in the foregoing specification. However, the invention which is intended to be protected is not to be construed as limited to the particular embodiments disclosed. Further, the embodiment described herein is to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

The invention claimed is:

1. A cryogenic refrigerator comprising:

a discharging port for pressure-feeding a refrigerant;

a suction port for sucking the refrigerant;

a pressure feeding means including the discharging port and the suction port;

a refrigeration means for refrigerating a body to be refrigerated;

a high pressure passage for establishing communication between the discharging port of the pressure feeding means and the refrigeration means, the high pressure passage being introduced with the refrigerant with relatively high pressure;

a low pressure passage for establishing the communication between the suction port of the pressure feeding means and the refrigeration means, the low pressure passage being introduced with the refrigerant with relatively low pressure; and at least one heat exchanger at the high pressure passage for refrigerating the refrigerant introduced at the high pressure passage by heat exchange, the heat exchanger including an active pressure drop type heat exchanger for declining pressure of the refrigerant at the high pressure passage before being introduced into the refrigeration means, wherein the active pressure drop type heat exchanger declines the pressure of the refrigerant with a ratio equal to or greater than 5 percent out of 100 percent and refrigerates the refrigerant when a pressure difference between a pressure of the refrigerant before being introduced into the active pressure drop type heat exchanger and a pressure of the refrigerant before being introduced into the refrigeration means is defined as 100 percent, and wherein the active pressure drop type heat exchanger declines the pressure of the refrigerant with a ratio equal to or greater than 50 percent out of 100 percent when the pressure difference between the pressure of the refrigerant before being introduced into the active pressure drop type heat exchanger and the pressure of the refrigerant before being introduced into the refrigeration means is defined as 100 percent.

2. The cryogenic refrigerator according to claim 1, wherein the active pressure drop type heat exchanger is at least one of the plural heat exchangers arranged in series and positioned closest to the refrigeration means relative to a flow of the refrigerant.

3. The cryogenic refrigerator according to claim 1, wherein the pressure of the refrigerant before being introduced into the active pressure drop type heat exchanger is determined to be 0.1–1000 Mpa and the active pressure drop type heat exchanger declines a temperature of the refrigerant with a ratio equal to or greater than 5 percent when a temperature difference between a temperature of the refrigerant before being introduced into the active pressure drop type heat exchanger at the high pressure passage and a temperature of the refrigerant before being introduced into the refrigeration means is defined as 100 percent.

4. The cryogenic refrigerator according to claim 1, wherein the active pressure drop type heat exchanger includes a counterflow type heat exchanger for refrigerating the refrigerant at the high pressure passage by heat exchange with the refrigerant at the low pressure passage.

5. The cryogenic refrigerator according to claim 1, further comprising:

a pre-cooling refrigerator; wherein the high pressure passage includes a pre-cooling portion for pre-cooling the refrigerant at the high pressure passage with the pre-cooling refrigerator.

6. The cryogenic refrigerator according to claim 5, wherein the pre-cooling refrigerator includes one of a pulse tube refrigerator, a Gifford McMahon refrigerator, a Solvay type cryogenic refrigerator, a Vuilleumier refrigerator, and a Stirling type cryogenic refrigerator.

7. The cryogenic refrigerator according to claim 5, wherein the pressure feeding means supplies the refrigerant compressed to have a high pressure into the high pressure passage and into the high pressure passage of the pre-cooling refrigerator.

8. The cryogenic refrigerator according to claim 1, further comprising:

a pressure drop passage in communication with the high pressure passage and for exchanging the heat with a heat exchange medium, the pressure drop passage provided at the active pressure drop type heat exchanger; wherein the pressure drop passage includes a diameter determined to be 0.1–15 millimeters and a passage length determined to be 0.1–200 meters.

9. The cryogenic refrigerator according to claim 1, further comprising:

a spirally formed pressure drop passage, in communication with the high pressure passage, and for exchanging heat with a heat exchange medium, the pressure drop passage provided at the active pressure drop type heat exchanger.

10. The cryogenic refrigerator according to claim 1, further comprising:

a pressure drop passage in communication with the high pressure passage and for exchanging heat with a heat exchange medium, the pressure drop passage provided at the active pressure drop type heat exchanger; and a resistive element serving as a resistance against a flow of the refrigerant, the resistive element provided at the pressure drop passage.

11. The cryogenic refrigerator according to claim 1, further comprising:

a passage forming member in communication with the high pressure passage and for forming a pressure drop passage for exchanging heat with a heat exchange medium, the passage forming member provided at the active pressure drop type heat exchanger; and a spacer member provided on the passage forming member for forming a passage where the heat exchange medium flows.

12. The cryogenic refrigerator according to claim 1, further comprising:

a porous body for forming a pressure drop passage with small bore in communication with the high pressure passage and for exchanging heat with a heat exchange medium, the porous body provided at the active pressure drop type heat exchanger.

13. The cryogenic refrigerator according to claim 1, further comprising a pressure drop passage in communication with the high pressure passage and for exchanging heat with a heat exchange medium, the pressure drop passage provided with a plurality of plate members including a penetration bore.

14. The cryogenic refrigerator according to claim 11, wherein the spacer member includes projections provided at an external surface of a spirally wound tube including the pressure drop passage.

15. The cryogenic refrigerator according to claim 11, wherein the spacer member includes a wire provided at an external surface of a spirally wound tube including the pressure drop passage.

* * * * *